US011732433B1

(12) United States Patent
McKinney et al.

(10) Patent No.: US 11,732,433 B1
(45) **Date of Patent: *Aug. 22, 2023**

(54) RISER SECTIONS AND RISERS MADE THEREFROM

(71) Applicant: Jerry L. McKinney, Silsbee, TX (US)

(72) Inventors: Jerry L. McKinney, Silsbee, TX (US); Rainer Kuenzel, Hunt, TX (US)

(73) Assignee: Jerry L. McKinney, Silsbee, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/334,692

(22) Filed: May 29, 2021

Related U.S. Application Data

(63) Continuation of application No. 15/234,464, filed on Aug. 11, 2016, now Pat. No. 11,021,848, which is a continuation of application No. 14/853,533, filed on Sep. 14, 2015, now abandoned, which is a continuation of application No. 13/523,089, filed on Jun. 14, 2012, now abandoned.

(51) Int. Cl.
*E02D 29/12* (2006.01)
*E03F 5/02* (2006.01)
*E03F 5/18* (2006.01)
*B65D 90/10* (2006.01)

(52) U.S. Cl.
CPC ..... *E02D 29/121* (2013.01); *B65D 90/105* (2013.01); *E02D 29/12* (2013.01); *E02D 29/124* (2013.01); *E02D 29/125* (2013.01); *E03F 5/02* (2013.01); *E03F 5/18* (2013.01)

(58) Field of Classification Search
CPC ..... E03F 5/18; E03F 5/024; E02D 29/121; Y10T 403/7005; Y10T 403/60; Y10T 403/606; Y10T 403/64; Y10T 403/648; Y10T 403/7045; F16L 37/098; F16L 37/0985; F16L 37/1205; F16L 37/133; F16L 37/26
USPC ..... 405/129.55, 133–135, 272; 52/19, 20, 52/848, 849; 403/326, 329, 335, 338, 403/364; 285/43; 220/4.24, 4.25, 324, 220/326
See application file for complete search history.

*Primary Examiner* — Amber R Anderson
*Assistant Examiner* — Stacy N Lawson
(74) *Attorney, Agent, or Firm* — Bushman Werner, P.C.

(57) ABSTRACT

A riser section having a generally tapered, e.g., frustoconical wall, the riser section having a first connector assembly at one end of the riser section and a second connector assembly at the other end of the riser section.

2 Claims, 13 Drawing Sheets

FIG.13
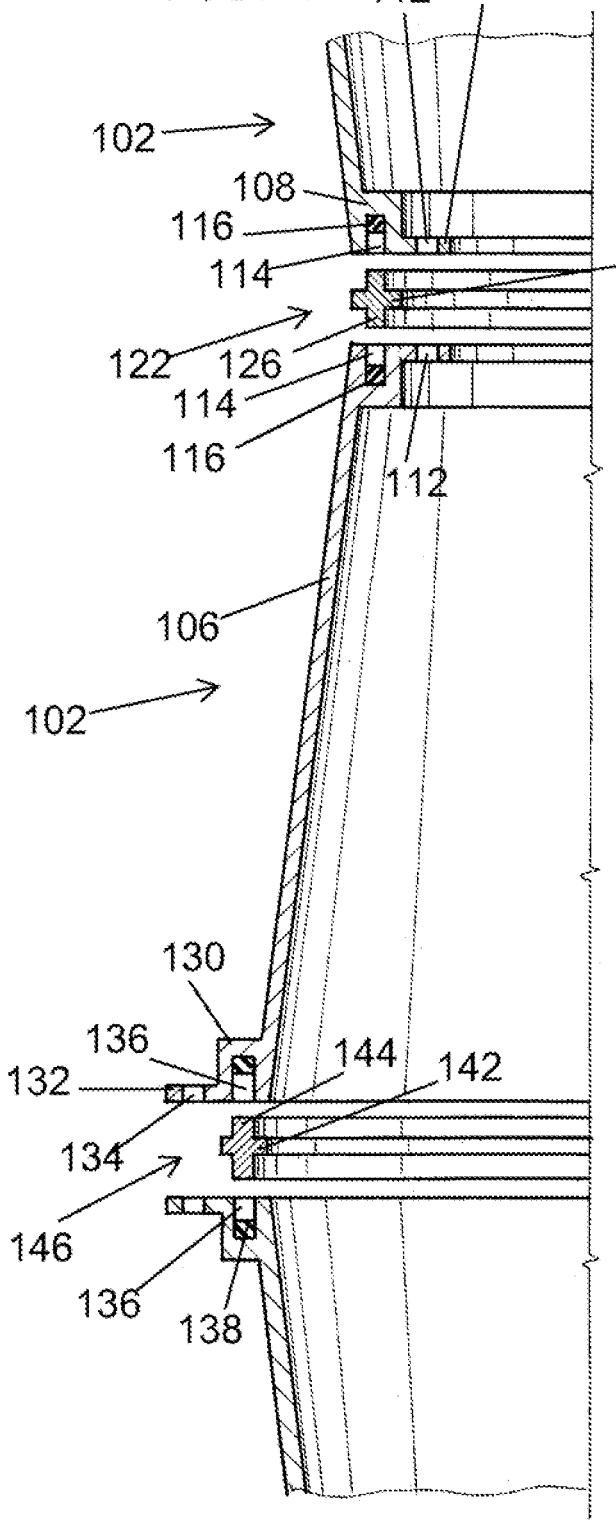
FIG.14
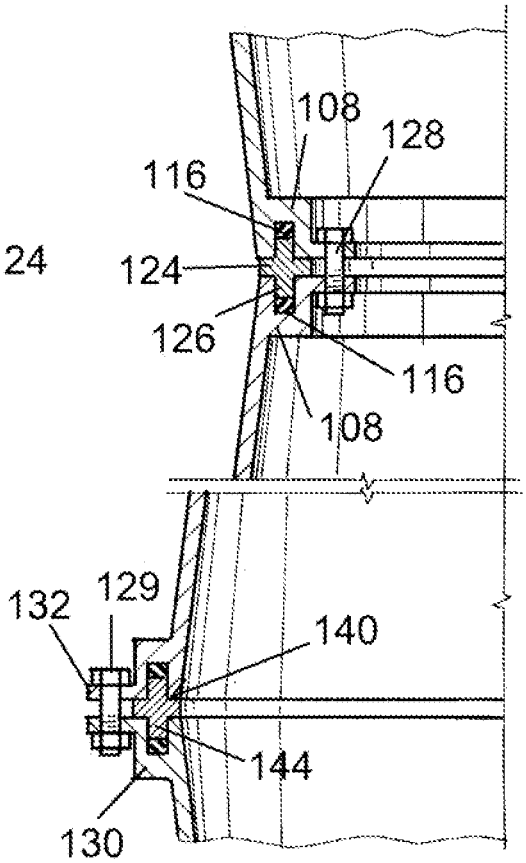
FIG.15
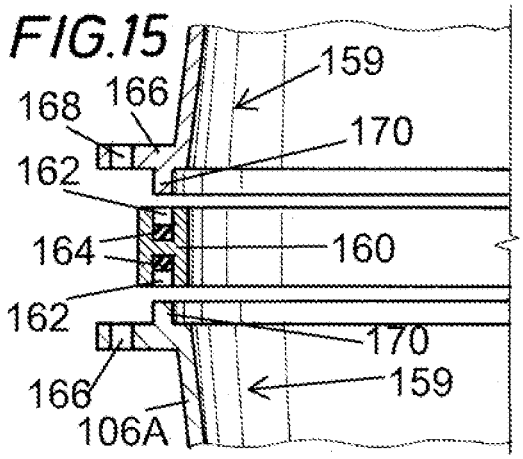
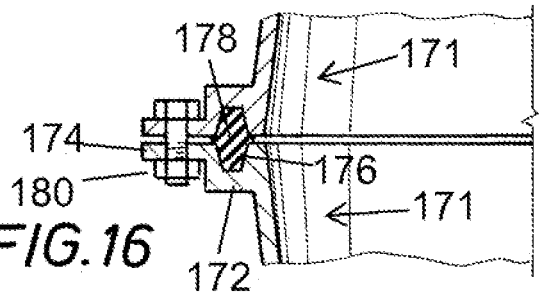
FIG.16

FIG. 24
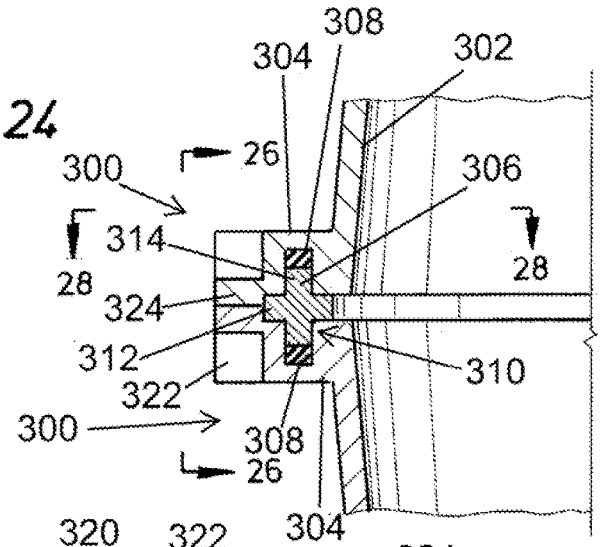
FIG. 25
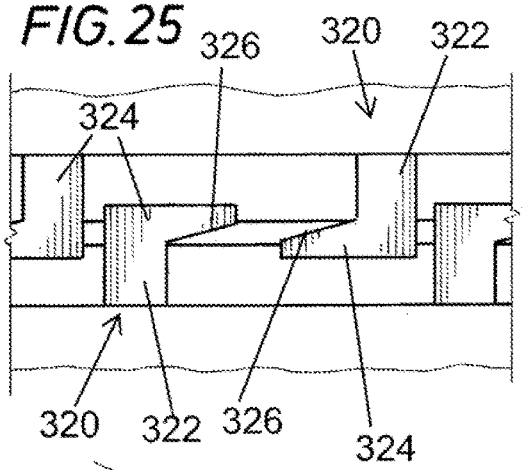
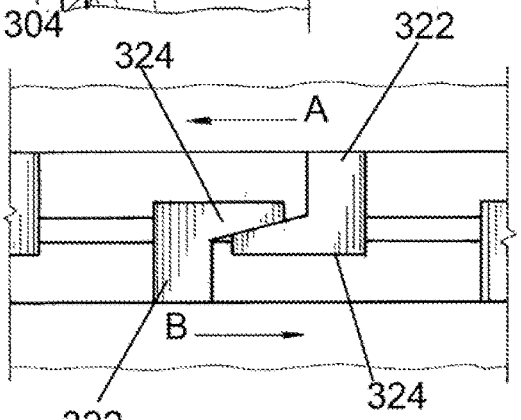
FIG. 26
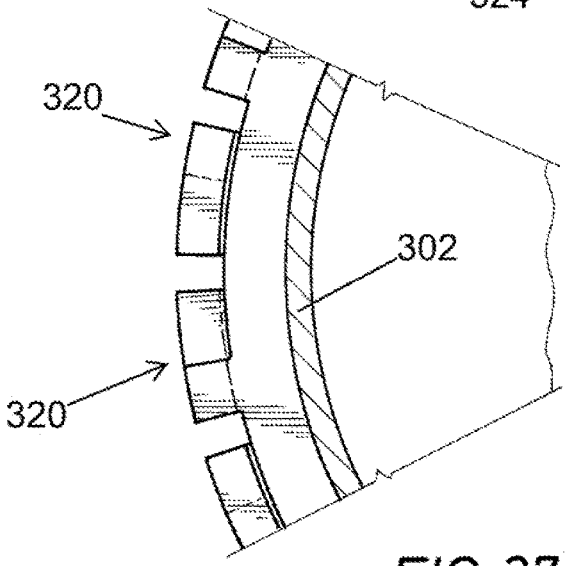
FIG. 27
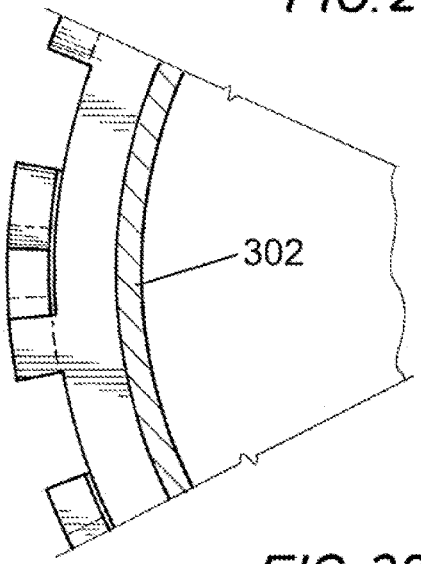
FIG. 28

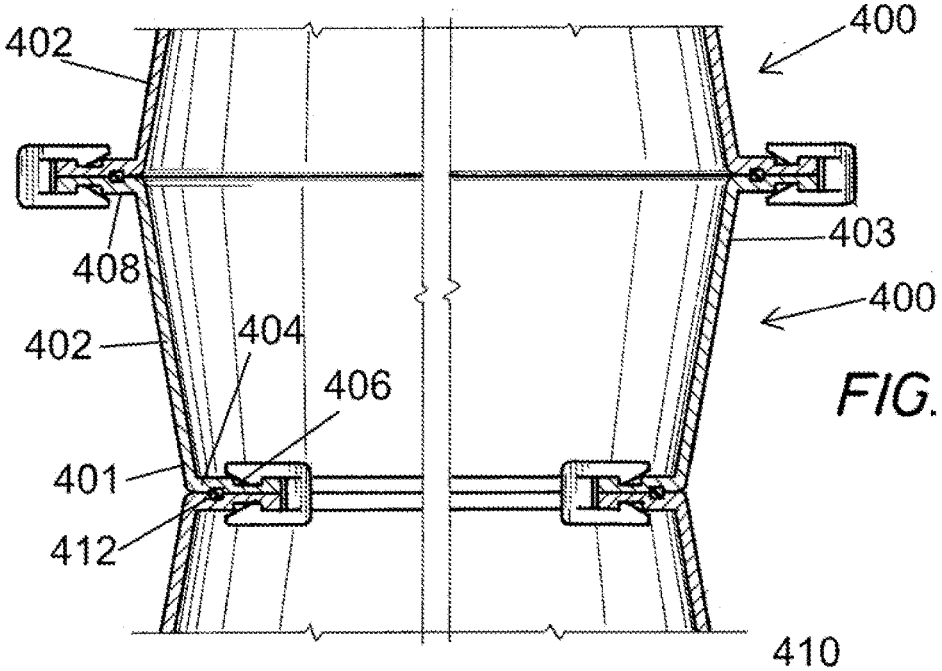
FIG. 29
FIG. 30
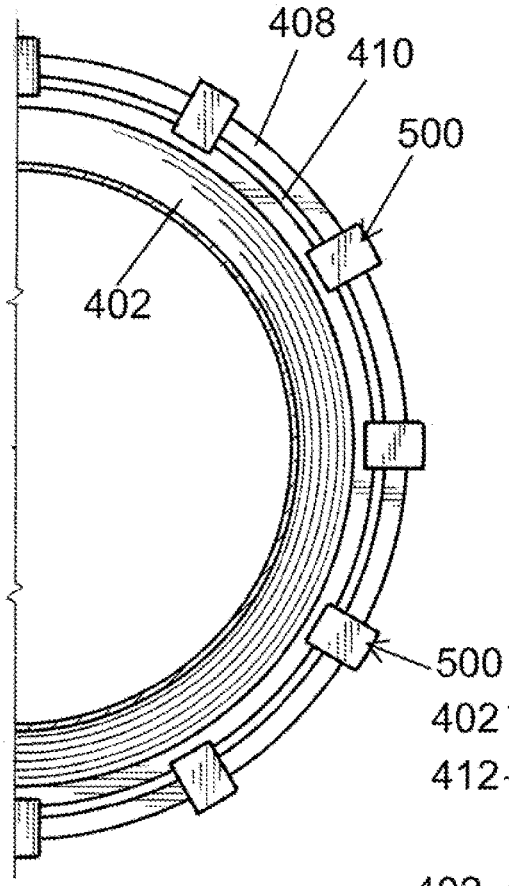
FIG. 31
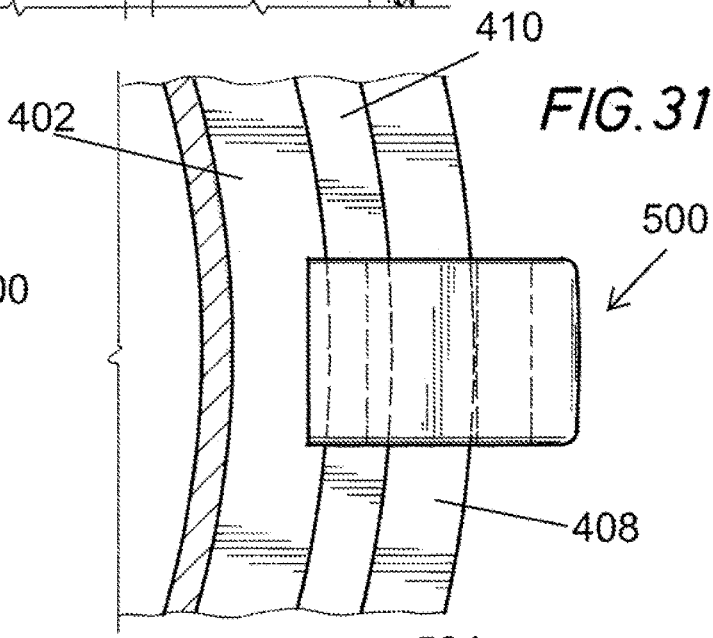
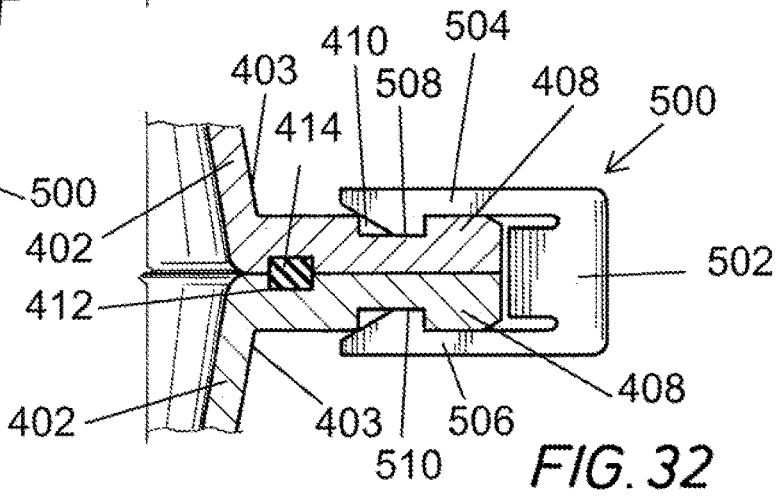
FIG. 32

RISER SECTIONS AND RISERS MADE THEREFROM

FIELD OF THE INVENTION

The present invention relates to riser sections, risers made therefrom and more particularly, to risers for use in waste-water treatment (WWT) systems or other buried structures.

BACKGROUND OF THE INVENTION

In WWT systems such as septic systems, aerobic waste-water treatment systems, etc., the main tank(s) are buried at a desired depth, depending upon the grade of the home or residence using the WWT system and other factors. Accordingly, there is a need in the WWT systems for risers, which extend from the buried tank to slightly above grade to allow access to the tank(s) for periodic cleanout, inspection of air diffusers, etc. Because the tank(s) are buried at different depths, it has been common in the industry to make riser sections; e.g., fiberglass, plastic, concrete, metal, etc. with different lengths. These different length riser sections are then connected in end-to-end relationship to achieve a desired overall length of the riser, which extends from the buried tank to about grade.

The problem with the use of these riser sections is they are not stackable or nestable, so that shipping large numbers of these riser sections becomes expensive. It is also recognized that these riser sections must have sufficient structural strength as to not collapse from the weight of surrounding soil.

SUMMARY OF THE INVENTION

In one aspect of the present invention, there is provided nestable, or stackable riser sections, which can be shipped much more economically.

In another aspect, the present invention provides a nestable riser section, having a first smaller diameter end, and a second larger diameter end.

In another aspect of the present invention, there is provided a nestable riser section, which can be easily molded using a single size mold.

A further aspect of the present invention is the provision of a riser section, which can be used to form risers with different size access openings at the end of the riser at, near or above grade.

Still a further aspect of the present invention is that there is provided a riser made from riser sections that has an access cover or hatch, which can be self locking and self sealing.

Another aspect of the present invention is that individual riser sections can be connected in end-to-end relationship without the necessity of screws, bolts or other type fasteners.

In yet another aspect of the present invention, there is provided a riser made up of riser sections for which no sealing means, e.g. caulking, O-rings or the like are necessary.

These and further features and advantages of the present invention will become apparent from the following detailed description, wherein reference is made to the figures in the accompanying drawings.

BRIEF DESCRIPTION OF THE DRAWINGS

FIG. 13 is an exploded, elevational view, partly in section, of a portion of the riser made using the riser sections shown in FIG. 12.

FIG. 14 is an elevational view, partly in section, showing how one end of the riser sections of FIG. 12 can be connected together to form a riser.

FIG. 15 is an exploded, elevational view, partly in section, of another embodiment of a riser section of the present invention.

FIG. 16 is an elevational view, party in section of another embodiment of a riser section of the present invention.

FIG. 24 is partial elevational view, partly in section, showing another embodiment of a riser section of the present invention.

FIG. 25 is a partial, elevational view showing the connectors of the riser sections of FIG. 24 prior to engagement.

FIG. 26 is a view of the connectors taken along the lines 26-26 of FIG. 24.

FIG. 27 is a partial, top, planar view of the riser sections of FIG. 24 shown in the position depicted in FIG. 25.

FIG. 28 is a top, planar view of the riser sections of FIG. 24 shown in the position depicted in FIG. 26.

FIG. 29 is a partial, elevational view, partly in section, showing another embodiment of the riser section of the present invention.

FIG. 30 is a partial, top, planar view of the riser section shown in FIG. 29.

FIG. 31 is an enlarged, top, planar view of a portion of the riser section shown in FIG. 30.

FIG. 32 is a partial, elevational view, partly in section, showing the details of the connection assembly used in the embodiment shown in FIG. 29.

DETAILED DESCRIPTION OF PREFERRED EMBODIMENTS

As used in the present invention, the term "stackable" or "nestable" refers to a structure of similar size and/or configuration, which can fit together in a separable manner; i.e., a series of structures wherein respective ones of said structures can fit into or on respective others of said structures. While, in general, the riser sections of the present invention will have a circular cross-section, it will be appreciated that other tapered stackable configurations could also be used.

The terms "engagement," "engagement assembly," "connection," "connector assembly," "connector" or similar words and terms as used herein refer to any formation(s), part, group of parts, whether forming part of the riser sections or separate therefrom, which are useful in connecting the individual riser sections together to form a riser.

While the present invention will be described with respect to a buried tank forming part of a WWT system, it will be understood that it is not so limited. For example, the riser sections of the present invention can be used to form risers for lift stations, to an underground shelter; e.g., storm shelter, or any other underground on buried structure.

Figure 1:
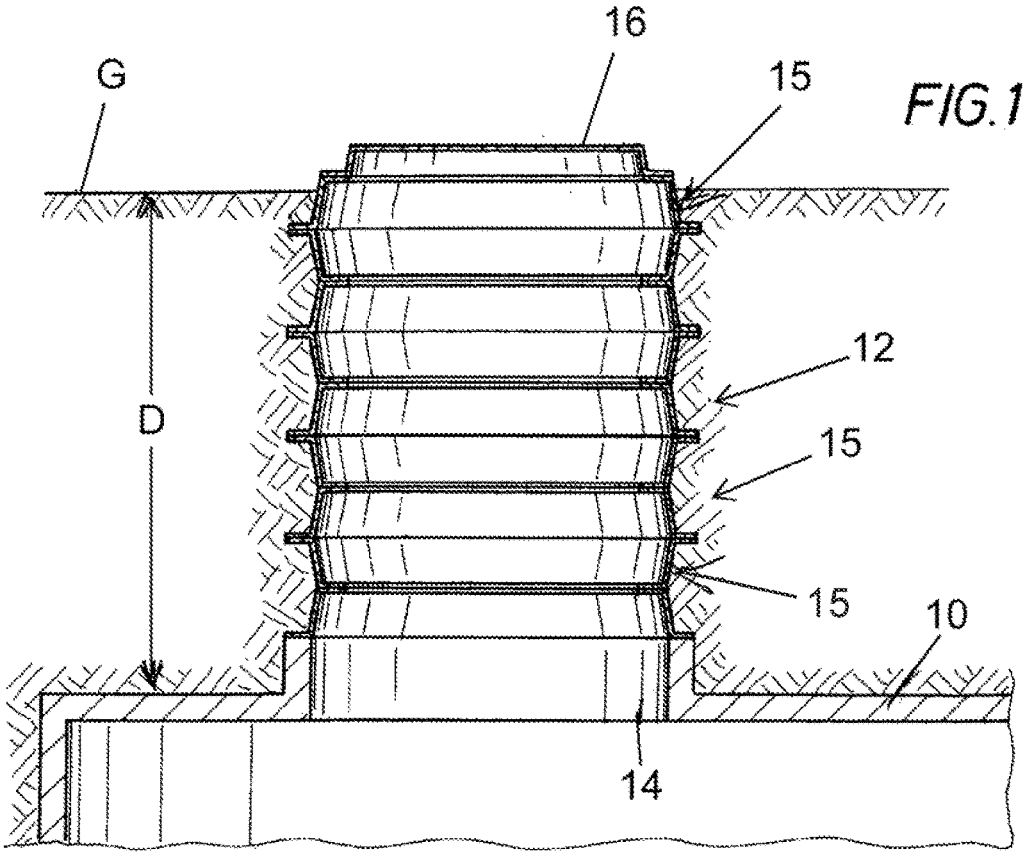
FIG. 1 is an environmental view showing a series of riser sections according to one embodiment of the present invention forming a riser extending from a buried tank to about grade.

Referring first to FIG. 1, there is shown a portion of a buried tank 10 forming part of a WWT system, buried at a distance D below ground level G. A riser shown generally as 12 extends from an opening 14 in tank 10 to slightly above ground level G. Riser 12 is made up of a series of riser sections 15 connected together, so as to achieve a length at least equal to the distance D and, as can be seen, slightly greater than distance D to extend above ground level G. A cover 16 is attached to the top of riser 12, cover 16 being selectively removable to access the interior of tank 10 through riser 12.

Referring now to FIG. 2, one of the riser sections 15 is shown in an isometric view. Riser section 15 has an annular radially inwardly extending lip, shown generally as 17, having an upper, annular, axially facing surface 17A, and a radially outwardly extending, annular flange 18, flange 18 and lip 17 being connected to opposite ends of a generally frustoconical wall 20. Wall 20 has a series of circumferentially spaced, vertically extending recesses 21 having vertical walls 21A. While recesses 21 are shown as being spaced at 90° intervals to one another, it will be understood that fewer such recesses can be used to allow for connection of lateral piping (not shown) connected to riser 12. Indeed, such recesses 21 can be dispensed with if desired.

Projecting upwardly from surface 17A of lip 17 are a pair of headed keys 22, keys 22 being circumferentially displaced 180° from one another. Also formed in lip 17 are a pair of keyholes 24, keyholes 24 being spaced at 180° from one another and accordingly, at 90° from keys 22. There is an annular groove 19 in surface 17A for the receipt of an O-ring or similar seal.

Figure 3:
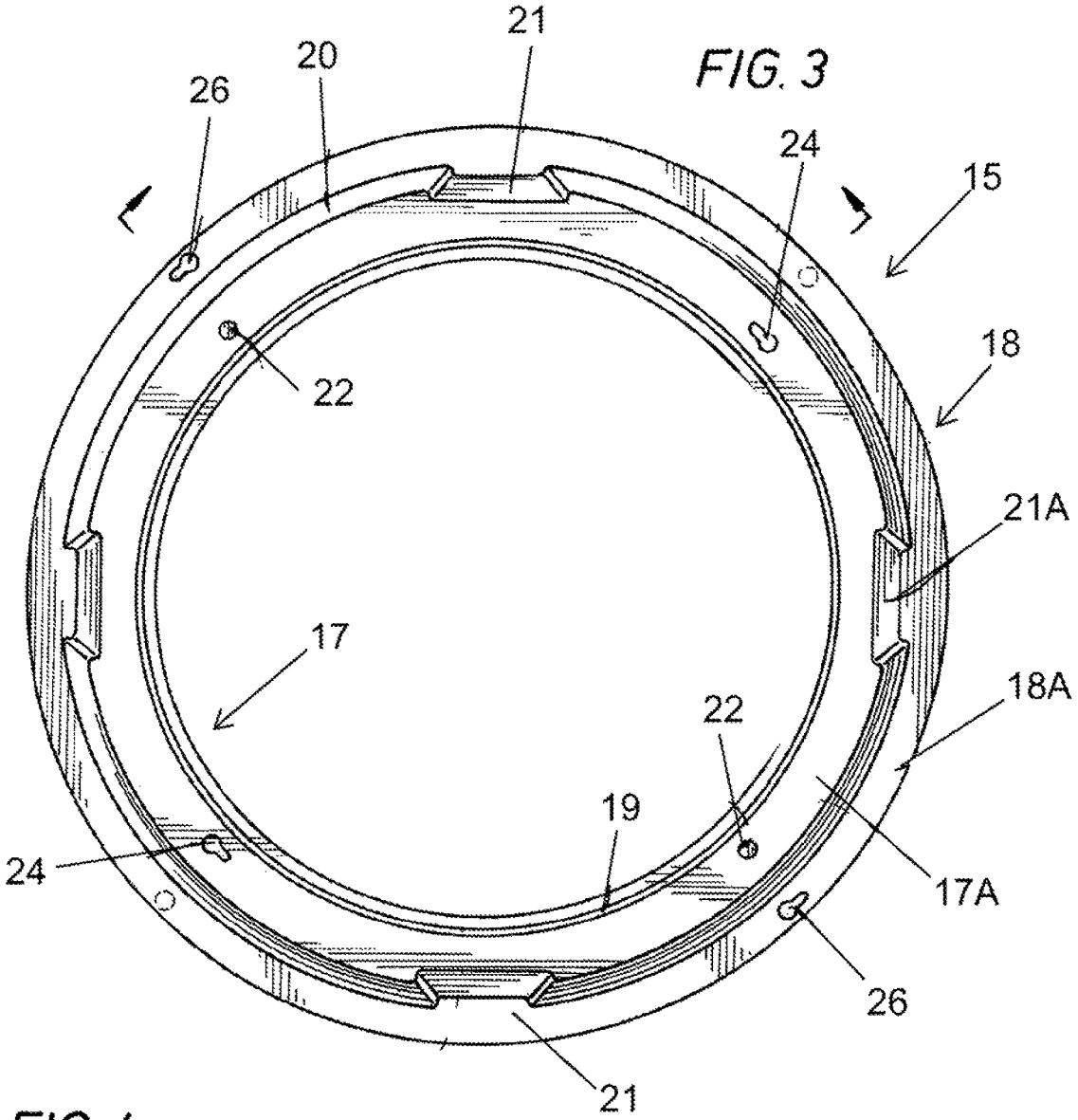
FIG. 3 is a top plan view of the riser section shown in FIG. 2.

Referring now to FIG. 3, it can be seen that flange 18 has a pair of keyholes 26, keyholes 26 being generally coplanar with one another and with keys 22 and circumferentially spaced at about 180°.

Figure 4:
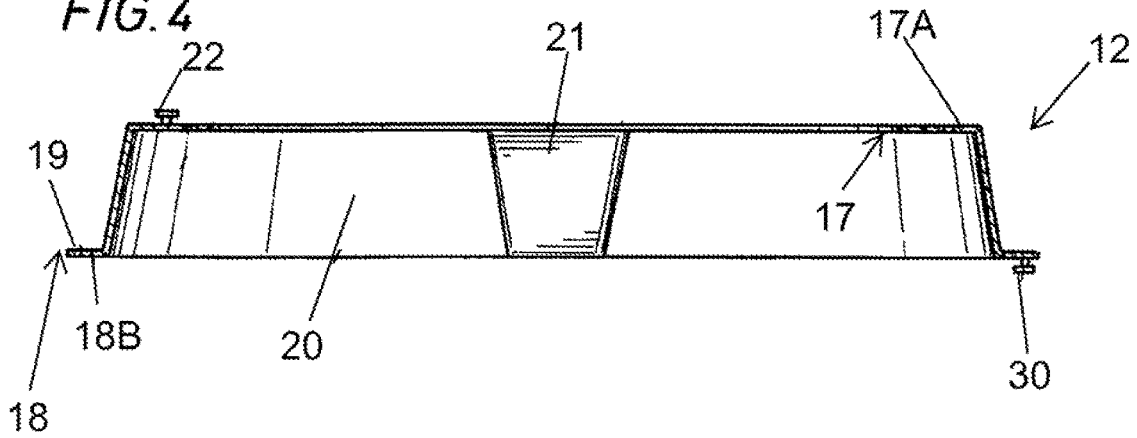
FIG. 4 is an elevational view, partly in section, taken along the lines 4-4 of FIG. 3.

Referring now to FIG. 4, it can be seen that the bottom surface 18B of flange 18 has a key 30 similar to keys 22. Although only one such key 30 is shown in FIG. 4, as can be seen from FIG. 3, there are two such keys 30 displaced 180° from one another, keys 30 being generally coplanar with keyholes 24.

Figure 5:
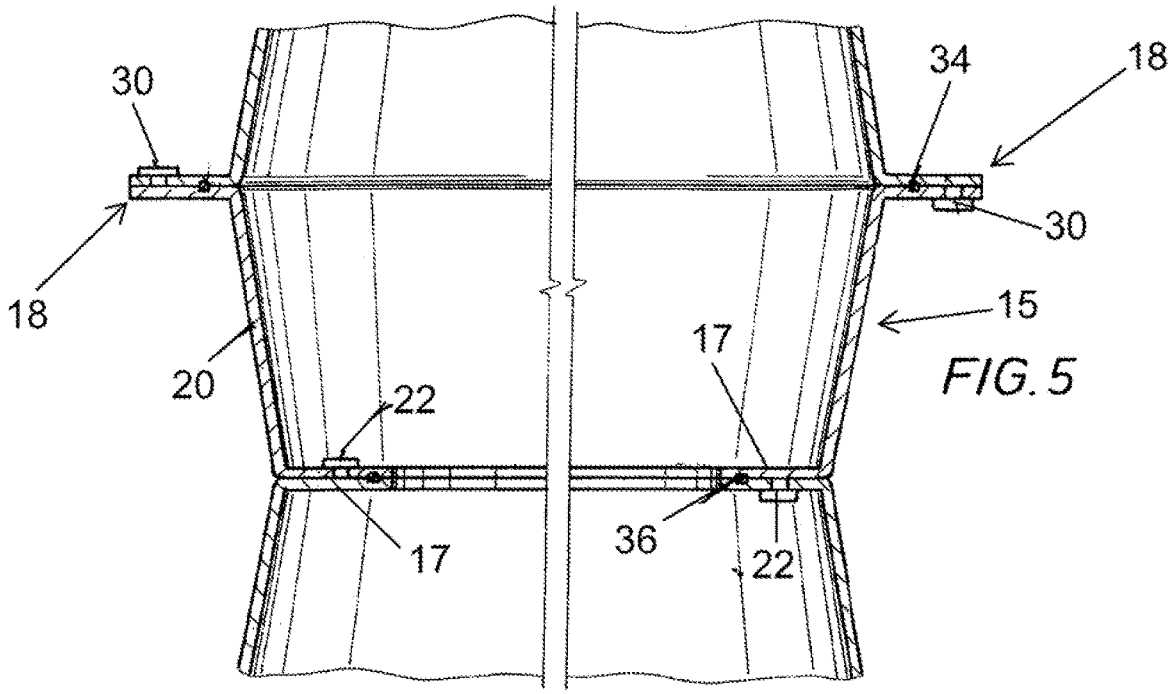
FIG. 5 is an enlarged, detailed view showing the riser sections shown in FIGS. 1-3 connected together to form a riser.

Referring now to FIG. 5, several riser sections 15 are shown connected together. To this end, it will be appreciated and as seen in FIG. 5, the flanges 18 of adjacent riser sections 15 are in abutment as are lips 17 of adjacent riser sections 15. To connect successive sections 15, keys 22 of one section are brought in to register with keyholes 24 of a second riser section. In like fashion, keys 30 of one riser section are brought into register with keyholes 26 of the adjoining riser section. It will be appreciated that the heads of the keys 22 will fit through the larger diameter portion of the keyholes 24, while the heads of the keys 30 will fit through the larger diameter portion of the keyholes 26. Once the keys 22, 30 are inserted into the keyholes 24, 26, respectively, slight rotation of the abutting sections 14 forces the heads of the keys under the smaller openings of the keyholes, effectively locking the sections together. To effect sealing between the adjacent sections 15, O-rings 34 and 36 are received in registering groove 19 in the abutting surfaces of flanges 18 and the abutting surfaces of lips 17, respectively. Although O-rings are shown as the sealing means between the adjacent sections 14, it will be appreciated that caulking, gaskets or other sealing means can be employed.

Figure 2A:
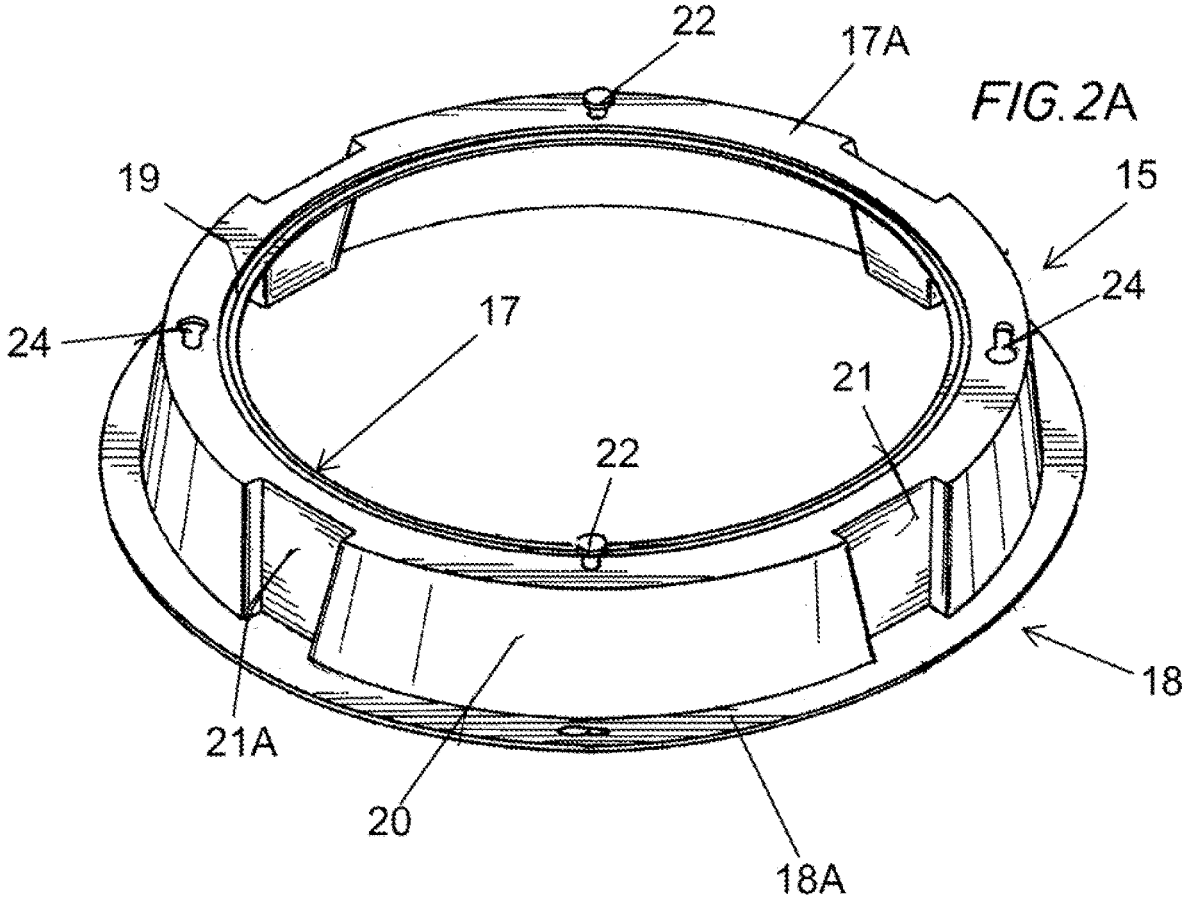
FIG. 2A is an isometric view of one embodiment of a riser section of the present invention.
Figure 2B:
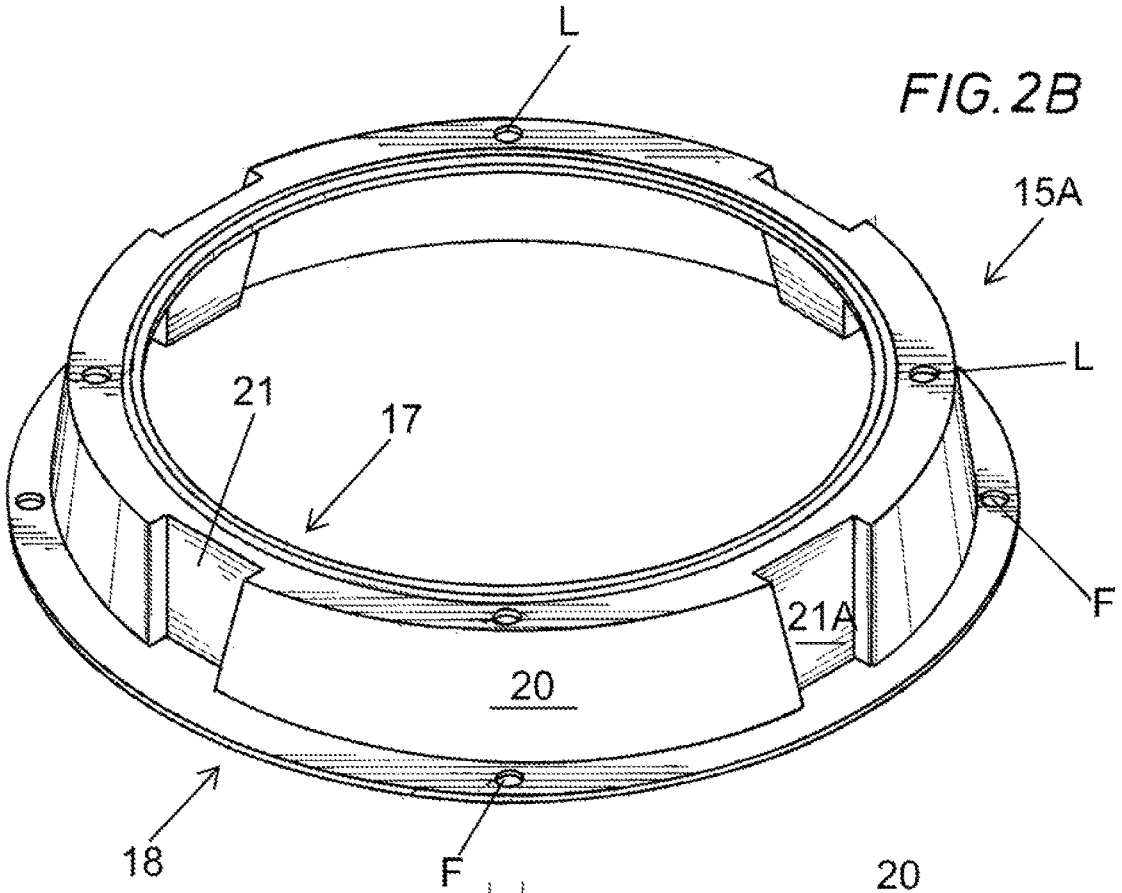
FIG. 2B is an isometric view, similar to FIG. 2A of another embodiment of the riser section of the present invention.

Referring now to FIG. 2B, there is shown a slightly modified form of the riser section in FIG. 2A. The riser section as shown in FIG. 2B differs from that shown in FIG. 2A in that instead of keys 22 and keyholes 24 and lip 17 of the embodiment shown in FIG. 2A, in the embodiment shown in FIG. 2B, the keys and keyholes have been replaced by circumferentially spaced holes L in lip 17. Likewise, instead of flange 18 of the embodiment shown in FIG. 2A having alternating keys and keyholes, in the embodiment of FIG. 2B, the keys and keyholes are replaced by a plurality of circumferentially spaced holes F.

Figure 2C:
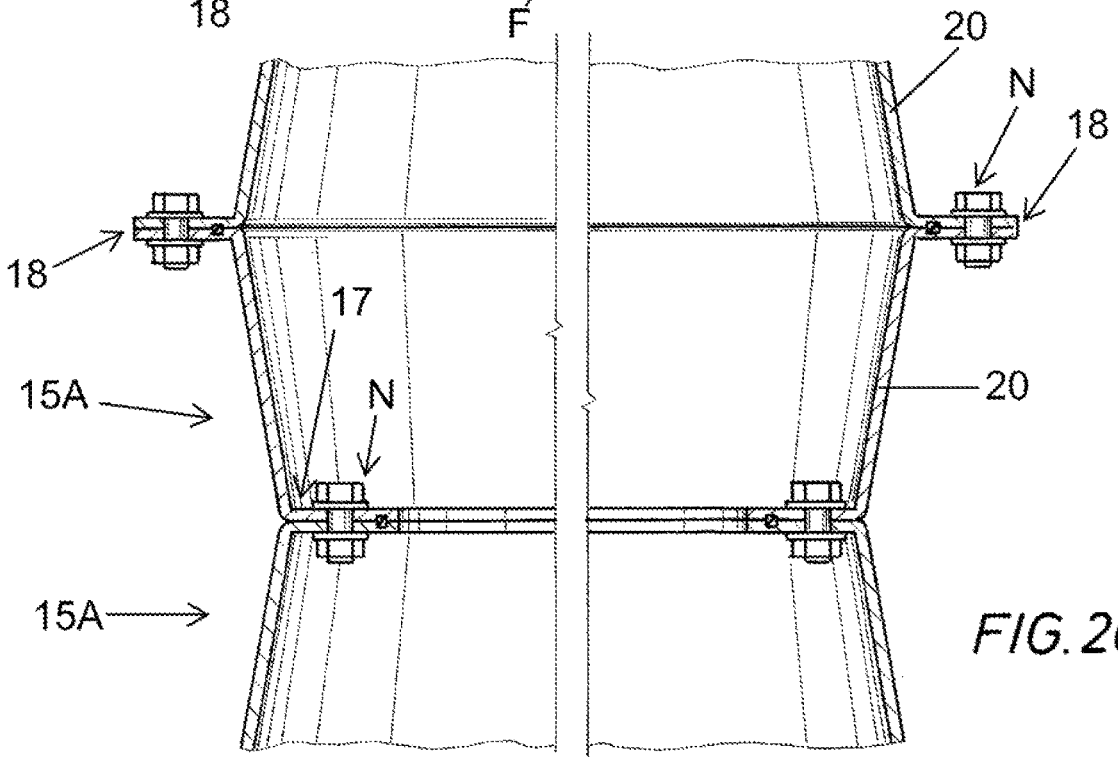
FIG. 2C is an elevational view, party in section, showing riser sections shown in FIG. 2B connected together to form a riser.

As can be seen in FIG. 2C, the riser sections of FIG. 2B are connected together by the use of nut/bolt assemblies N. In all other respects, the embodiment shown in FIG. 2B is substantially the same as that shown in FIG. 2A.

One of the features of the embodiment of the present invention shown in FIGS. 1-5 is that, the lips 17 and the flanges 18 provide reinforcement. Accordingly, the walls 20 of the sections 15 need not be thick, meaning that the sections are light-weight and require less material greatly minimizing their cost of manufacturing and shipping. In other words, lips 17 and flanges 18 resist external pressure from soil that surrounds the riser sections 15, forming riser 12 when in place.

In connecting successive riser sections together, and as shown in FIG. 5, and assuming that the larger or flanged end of the riser section 15 were to be connected, the keys 30 on the flange of one riser section would be received in the keyholes 26 of an adjacent riser section such that the headed portion of the keys extended through the larger diameter end of the keyholes. With a slight twist, the two riser sections would then be locked together.

Figure 6:
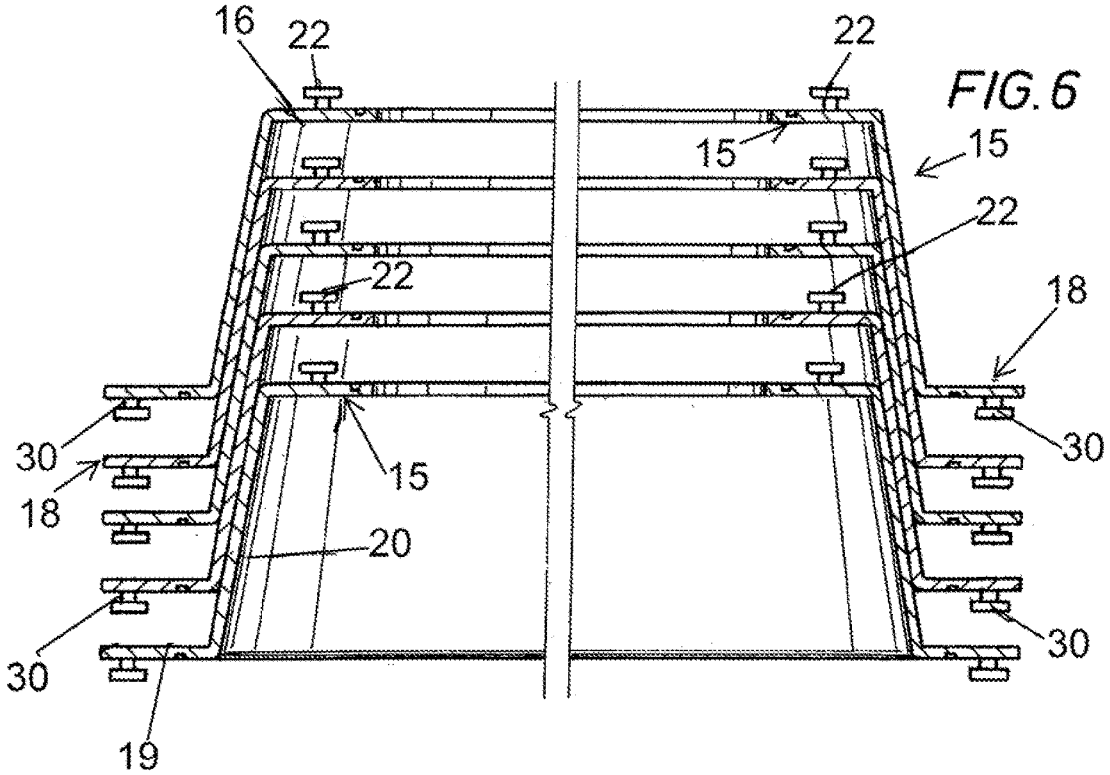
FIG. 6 is an elevational view, partly in section, of the riser sections shown in FIGS. 1-5 nested or stacked.

Referring now to FIG. 6, there is shown one of the advantages of the riser sections of the present invention. As shown, five riser sections 15 are shown in a stacked or nested arrangement for shipping. Because of the unique design of the riser sections of the present invention, they easily nest in one another, minimizing the amount of vertical volume that they occupy and accordingly, greatly reducing storage and/or shipping costs. For example, prior art riser section, since they are cylindrical, must be stacked in end-to-end relationship. Accordingly, and with reference to FIG. 6, it will be appreciated that if five prior art risers having a height H were stacked one upon another, they will occupy approximately five times the vertical volume occupied by five riser sections of the present invention, having an equal vertical height H.

While in the description above, the riser sections have been described in connection with forming a riser, which will extend between a buried tank or the like to slightly above grade, it will be recognized that the riser formed can, at its uppermost end, be at about grade; i.e., slightly below grade, at grade, or slightly above grade. Furthermore, it will be understood that the riser sections can be used to form risers which extend significantly above grade if such is needed. Also longitudinally extending tubular members made of riser sections 15 may be formed; e.g., to connect one buried structure to another buried structure.

In the embodiments discussed in FIGS. 1-6, while the use of a key and keyhole has been described as a means to connect individual riser sections to form a riser, it will be understood that the individual keys and/or the keyholes could be made with camming surfaces, such that when the key was inserted in the keyhole, a twisting action to connect individual riser sections together would result in the abutting surfaces of the riser sections being cammed together in water tight sealing engagement with one another. Accordingly, and as mentioned above, sealing means such as caulkings, O-rings, gaskets, etc., may not be unnecessary. Also, the locking formations, camming formations, etc. could be designed such that they included formations which acted like ratcheting mechanisms; i.e., when moved in one direction they cannot reverse direction, thereby ensuring that the riser sections would not separate from one another.

Figure 7:
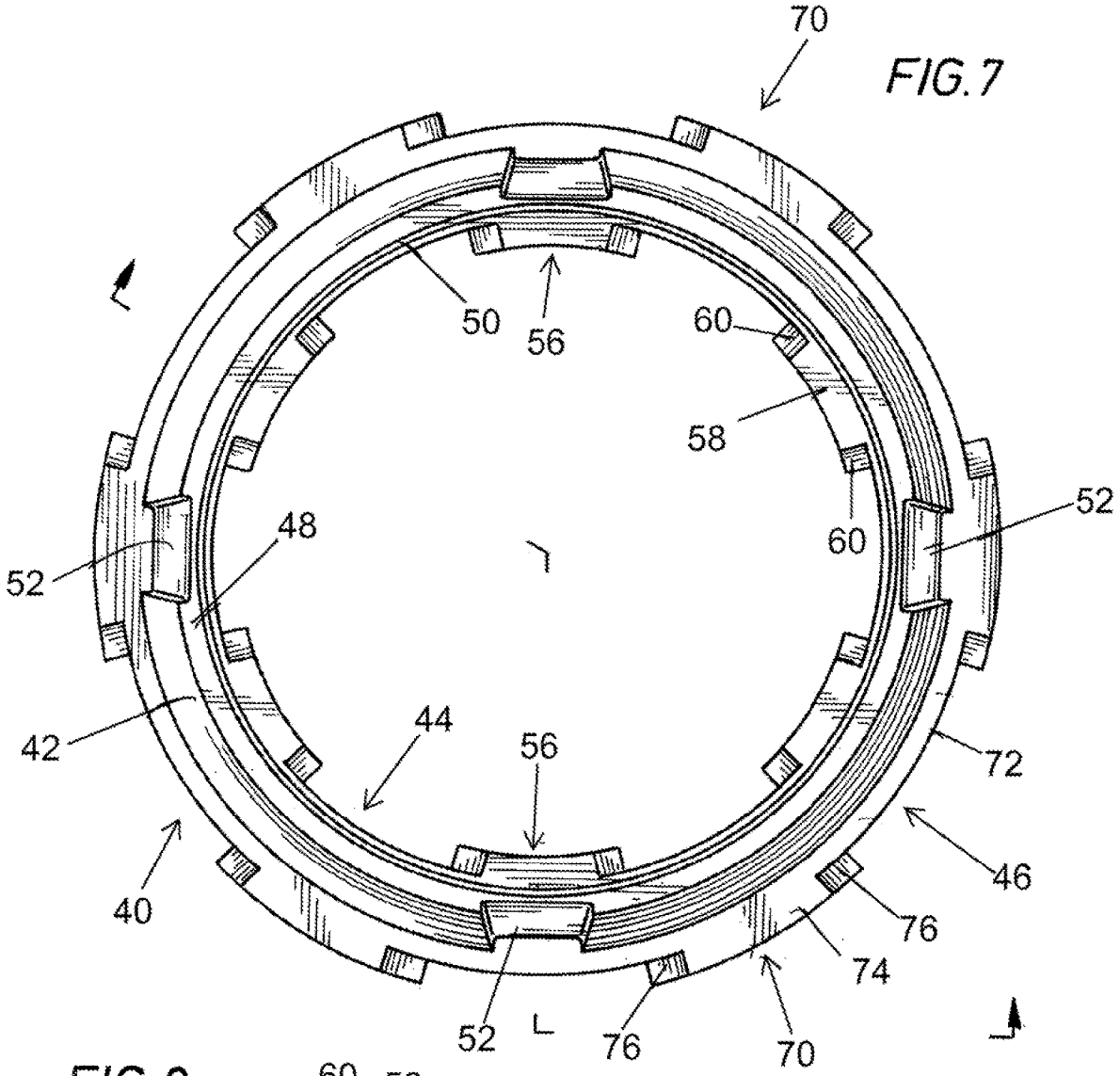
FIG. 7 is a top, plan view of another embodiment of a riser section of the present invention.
Figure 8:
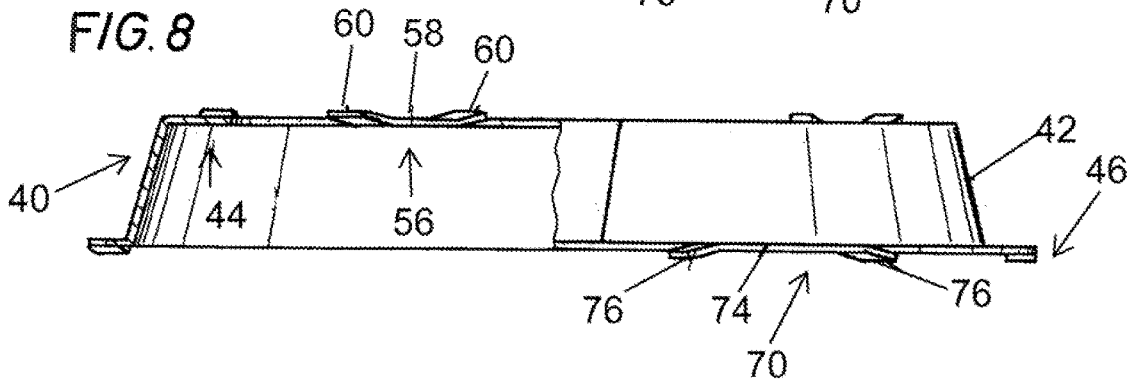
FIG. 8 is an elevational view, partly in section, of the riser section shown in FIG. 7.

Referring now to FIGS. 7-10, there is shown another embodiment of the riser sections of the present invention. Referring first to FIG. 7, a riser section shown generally as 40 comprises an annular, frustoconical wall 42, an annular, radially inwardly extending lip 44, projecting from one end of wall 42 and an annular, radially outwardly projecting flange 46, extending from the other end of wall 42. Upper, axial facing surface 48 of lip 44 has a seal ring groove 50. As in the case of the riser sections shown in FIGS. 1-6, riser sections 40 are provided with recesses 52 for the same purpose described above with respect to riser sections 14. Projecting radially inwardly from lip 44 are a series of a circumferentially spaced tabs 56, each of tabs 56 having an intermediate section 58 attached to the inner edge of and generally coplanar with lip 44, and oppositely spaced, free flaps or wings 60 attached to the ends of intermediate section 58. As best seen in FIG. 8, flaps 60 are not coplanar with intermediate section 58, but project axially upwardly relative to surface 48 of lip 44.

In a similar fashion, a plurality of circumferentially spaced tabs 70 project radially outwardly from the outer edge 72 of flange 46. Like-tabs 56, tabs 70 have an intermediate portion 74, which is attached to and generally coplanar with flange 46. Likewise, each of tabs 70 has a pair of spaced flaps or wings 76, which project axially downwardly from flange 46. As will be seen hereafter, flaps 60 and 76 form ramps or camming surfaces to allow adjacent riser sections 40 to be connected in end-to-end relationship to form a riser.

Figure 9:
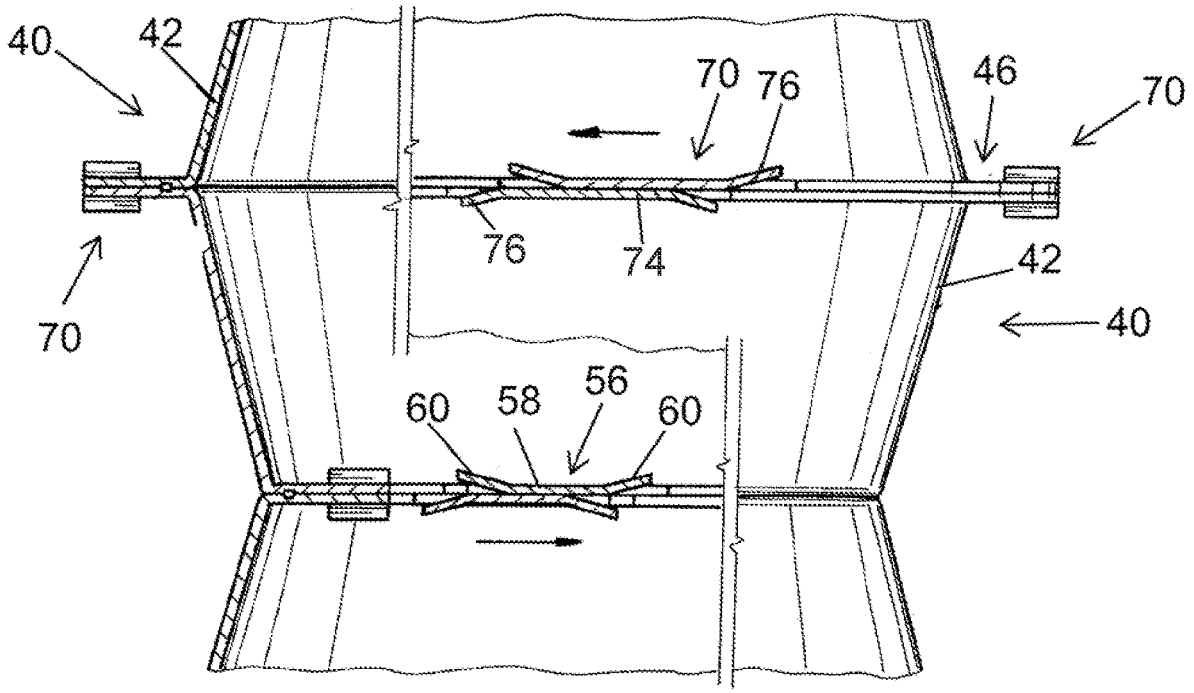
FIG. 9 is an enlarged, detailed showing the riser sections shown in FIGS. 7 and 8 connected together to form a riser.

It can be seen with reference to FIG. 7, that tabs 56 and tabs 70 are staggered relative to one another, vis-à-vis their circumferential spacing. With reference to FIG. 9, it will be appreciated that, during assembly, flanges 46 on adjacent section 40 are brought together such that tabs 70 on one riser section are positioned in the free spaces between the tabs 70 on the adjacent riser section 40. Thus, flanges 46 can be brought into abutment. It will now be seen from FIG. 9 that if there is relative rotation between adjacent sections 40, the ramps or camming surfaces formed by the flaps 76 of the tabs 70 of one riser section 40 will be forced under the ramps or camming surfaces formed by the flaps 76 of the adjacent riser section 40. Continued rotation will force the intermediate sections 74 over one another, as shown in FIG. 9. Likewise, this relative rotation between adjacent sections 40 will cause a like result with respect to tabs 56 on lips 44. In this way, it will be appreciated that the adjacent sections will be securely locked together. It will be appreciated that any form of sealing, e.g., O-rings, caulk or the like can be employed.

Figure 10:
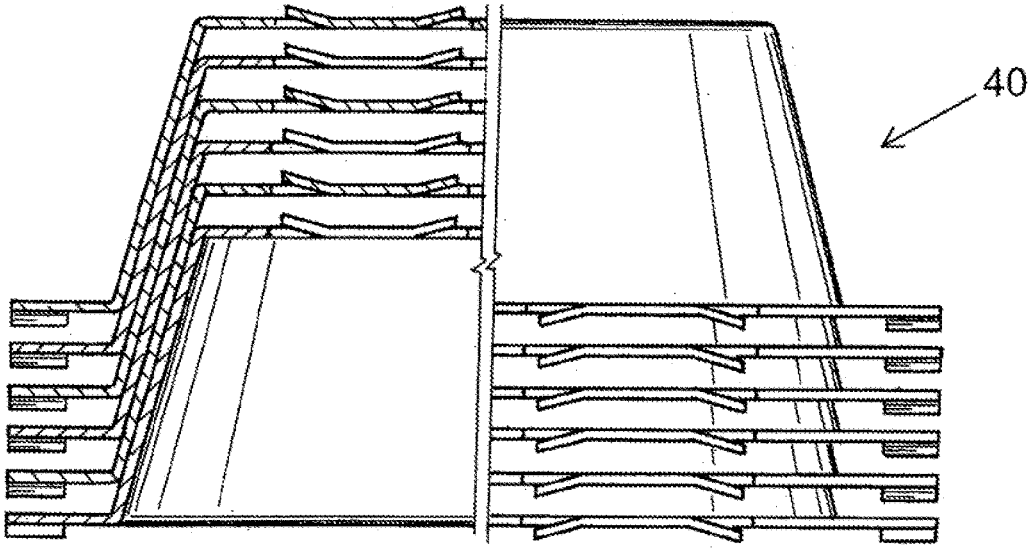
FIG. 10 is an elevational view, partly in section, of the riser sections shown in FIGS. 7-9 nested or stacked.

Referring now to FIG. 10, it can be seen that once again, the riser sections can be stacked or nested with the same result as described above with respect to the stacking or nesting of the riser sections 14 described in FIG. 6.

Figure 11:
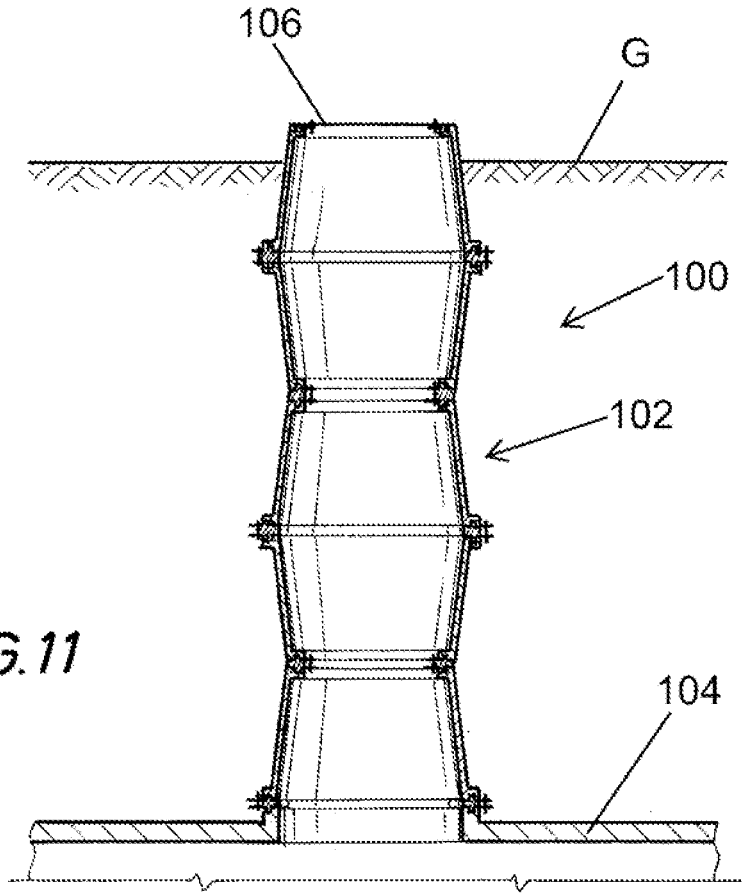
FIG. 11 is an environmental view showing a series of riser sections according to another embodiment of the present invention forming a riser extending from a buried tank to about grade.
Figure 12:
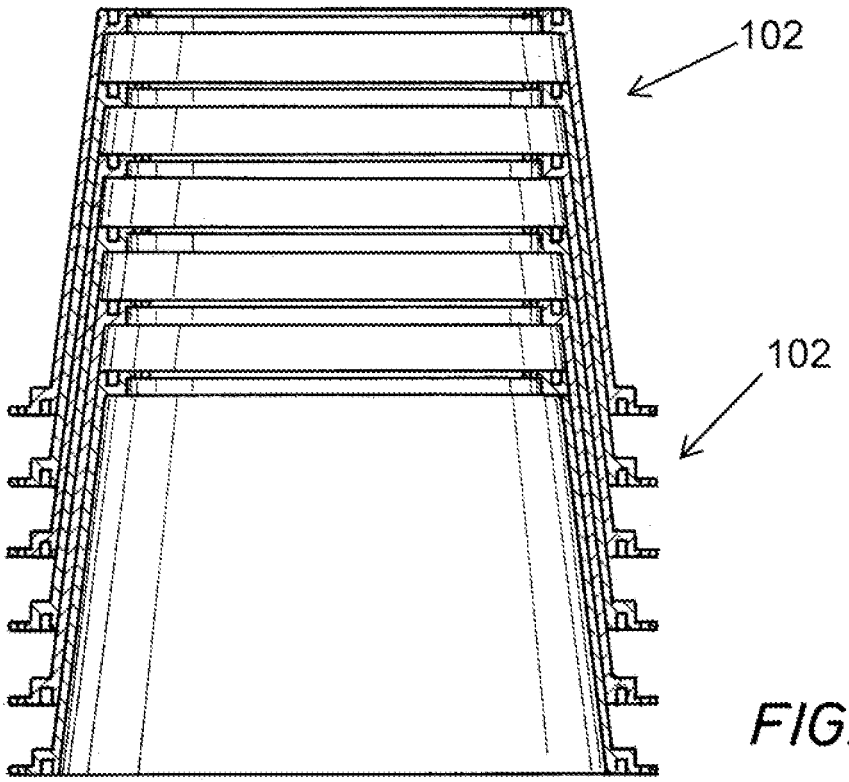
FIG. 12 is an elevational view, partly in section, of the risers sections used in the embodiment of FIG. 11 nested or stacked.

Referring now to FIGS. 11-14, there is shown a riser and riser sections according to another aspect of the present invention. Referring first to FIG. 11, a riser shown generally as 100, made up of riser sections shown generally as 102, extends from a buried tank or other structure 104 to slightly above ground level G, there being a removable lid or cover 106 on the uppermost section of riser 100. With reference to FIG. 12, there is shown a stack or nest of riser sections 102.

Referring now to FIG. 13, there is shown in detail how the riser sections 102 are connected. Each riser section 102 has a peripheral, frustoconical wall 106. The smaller diameter end of riser section 102 has an annular radially inwardly extending rib portion 108 from which there is a radially inwardly projecting annular lip 110, lip 110 having a series of circumferentially spaced holes 112. Rib 108 has an annular groove 114 in which is received an annular seal ring 116. To connect the smaller diameter end of successive riser sections 102 together, an annular ring 122 which is generally cross-shaped in cross-sectional configuration is employed.

Thus, ring 122 has a generally horizontally extending arm 124 and a generally vertically extending arm 126, arms 124 and 126 being substantially perpendicular to one another. The ends of vertical arm 126 are received in registering grooves 114 of successive riser sections 102 (see FIG. 14), the abutting, small ends of risers sections 102 being secured together by a nut/bolt combination 128 received through the registering holes 112 in lips 110 of riser sections 102.

The larger diameter end of riser section 102 includes an annular, radially outwardly extending rib 130 which projects outwardly from wall 106, rib 130 having an annular, radially outwardly extending flange 132 having a series of circumferentially spaced holes 134. Rib 130 has an annularly extending, axially facing groove 136 in which is received a seal ring 138. To connect the large diameter ends of riser sections 102 together, a ring 140 having a cross-shaped cross-section with a horizontal arm 142 and a vertical arm 144 is used. As is shown in FIG. 15, to assemble the large diameter ends of the riser sections, the vertical arms 144 of the ring 140 are received in the registering grooves 136 of the ribs 130 and a nut/bolt combination 129 is received through each of the registering holes 134 in the flanges 132 as shown in FIG. 15.

FIG. 15 shows another embodiment of the present invention which is a variation of that shown in FIGS. 13 and 14. In FIG. 15, ring 160 has an H-shaped cross-section forming axially facing, annularly extending grooves 162, seal rings 164 being received in grooves 162. An assembly flange 166 extends outwardly from frustoconical wall 106A and has a series of circumferentially spaced holes 168. Each of the ends of the riser sections 159 has an axially projecting, annularly extending splines 170, splines 170 being received in grooves 162 when respective riser sections 159 are secured together by means of nut/bolt assembly (not shown) extending through holes 168 in flanges 166.

FIG. 16 shows yet another embodiment of the present invention wherein the riser sections shown generally as 171 have at each end a rib 172 and radially outwardly extending flange 174. Formed in rib 172 is an annular groove 176. When sections 171 are connected, a seal ring 178 is sealingly engaged in registering grooves 176, the sections 171 being compressed together by a nut/bolt combination 180.

It will be understood that with respect to the embodiments shown in FIGS. and 16, that there will be a similar connector assembly comprised of the ribs, cross-shaped connecting rings, etc. on the smaller diameter ends of the riser sections, the ribs, projections, etc. being radially inwardly from the smaller diameter end, as opposed to radially outwardly from the larger diameter end as shown in FIGS. 15 and 16.

It will be understood that the embodiments shown in FIGS. 13-16, like the other embodiments described above are nestable or stackable so as to minimize storage and transportation costs.

Figure 17:
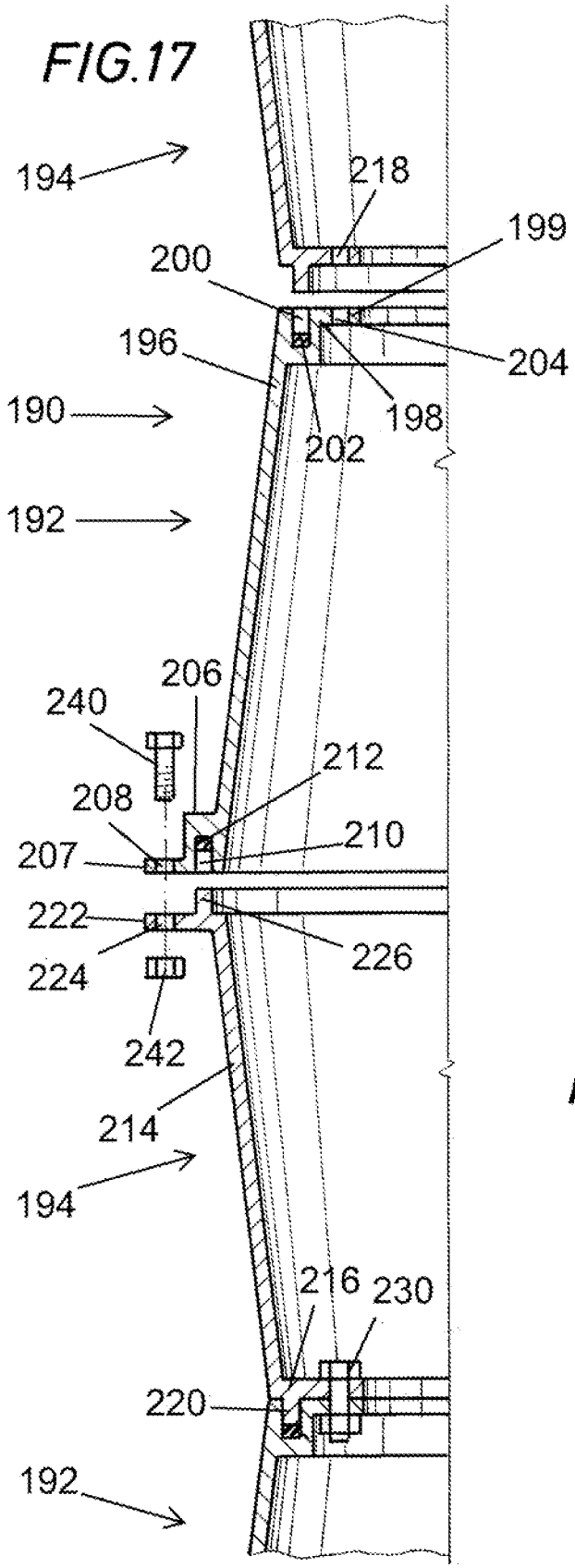
FIG. 17 is an exploded, elevational view, partly in section of a riser made using another embodiment of the present invention.
Figure 18:
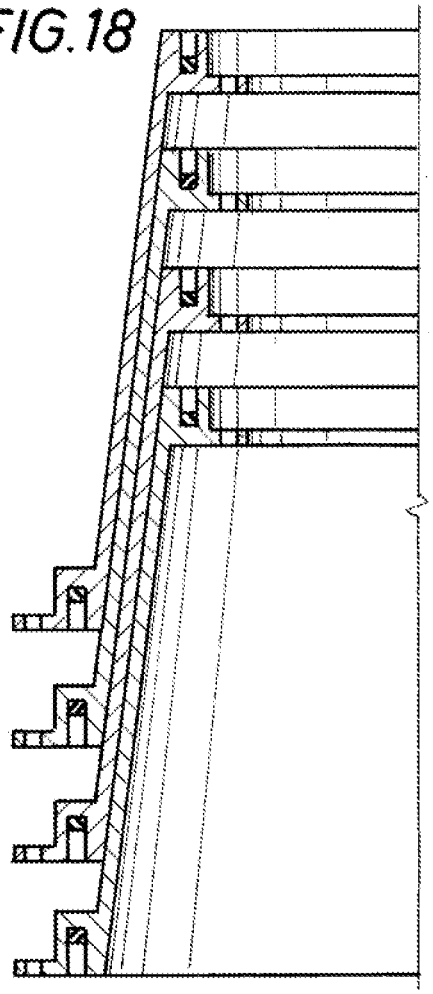
FIG. 18 is an elevational view, partly in section, showing one form of the riser sections of the embodiment of FIG. 17 nested or stacked.
Figure 19:
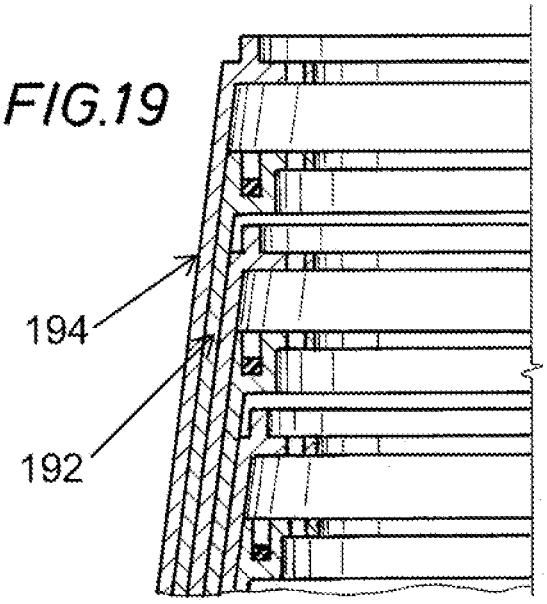
FIG. 19 is an elevational view, partly in section, showing both forms of the riser sections of the embodiment of FIG. 17 nested or stacked.

Referring now to FIGS. 17-19, there is shown another embodiment of the riser sections of the present invention. The riser sections shown in FIGS. 17-19 differ from those described above in that alternating riser sections have, at each end, either a male portion of a connector assembly or a female portion of a connector assembly. Referring now to FIG. 17, there is shown an exploded view of a riser shown generally as 190. Riser 190 is comprised of female riser sections 192 which have female connector assembly or engagement ends and male riser sections 194 which have male connector assembly or engagement ends. Finally, riser sections 192 have a generally frustoconical wall 196 with a first end having an annular, radially inwardly extending rib 198, a radially, inwardly extending, annular lip 199, and an annular groove 200, a seal ring 202 being received in groove 200. Lip 199 has a series of circumferentially spaced holes 204 for a purpose to be described hereafter.

The larger end of riser section 192 has an annular radially outwardly extending rib 206 having an annular, radially outwardly extending lip 207 with a series of circumferentially spaced bolt holes 208, and an annular axially facing groove 210, a seal ring 212 being received in groove 210.

Male riser section 194 has a generally frustoconical wall 214, the smaller diameter end of riser section 194 having an annular, radially inwardly extending lip 216 with a series of circumferentially spaced bores or openings 218. There is also an axially projecting, annularly extending rib 220. The larger diameter end of riser section 194 has an annular, radially outwardly extending flange 222 having a series of circumferentially spaced bolt holes 224 and an annular, axially facing rib 226.

To connect riser sections 192 and 194, and with respect first to the larger ends thereof, annular ribs 226 are received in annular grooves 210, ribs 226 engaging seal ring 212. When seated together, a bolt 240 is received through registering holes 208 and 224 and is threadedly connected to a nut 242 whereby the larger ends of the risers 192 and 194 are compressed together and are in fluid tight engagement by virtue of seal 212.

To connect the smaller ends of risers 192 and 194, rib 220 of riser 194 is received in groove 200 of riser 192 and a nut/bolt combination 230 received in registering holes 204 and 218 in riser sections 192 and 194, respectively, urge rib 220 into engagement with seal 202, thereby providing a fluid tight seal.

Although, as noted, the riser sections differ in that female riser sections 192 are provided with receiving formations, i.e., grooves 200 and 210 forming a female part of a connector or connecting apparatus, male riser sections 194 have projecting formations in the form of ribs 226 and 220. In other words, the respective ends of the riser sections have formations which are projecting as to one end and receiving as to other such that one riser section forms part of a connector or connector assembly having a female or receiving portion while an adjacent riser section has a connector or connector assembly comprised of a male or projecting formation.

It can also be seen that while the individual riser sections 192 and 194 differ in their connecting assemblies at their respective ends, each riser section is stackable. Thus, with reference to FIG. 18, the riser sections having the receiving or female formations forming part of the connector assembly are stackable with respect to one another whereas, as seen in FIG. 19, the riser sections can be alternated and still be stackable. In other words, with respect to FIG. 19, riser sections 192 and 194 can be alternately stacked. This is a clear advantage when the riser sections are being manually carried to the installation site.

Figure 20:
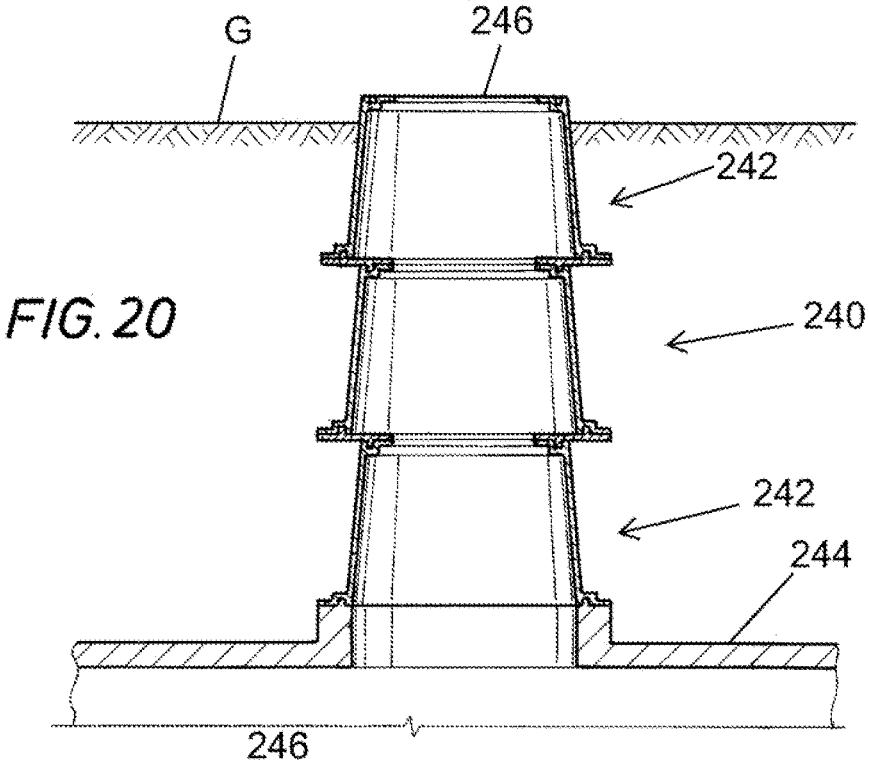
FIG. 20 is an environmental view, partly in section showing a series of riser sections according to another embodiment of the present invention, forming a riser extending from a buried tank to about grade.

Referring now to FIGS. 20-23, there is shown another embodiment of the riser sections and riser of the present invention. Referring first to FIG. 20, there is shown a riser 240 made up of riser sections 242, riser 240 extending from a buried tank 244 to slightly above grade, indicated as G, riser 240 having a removable lid 246 thereon. As noted above, by removing lid 246, one can access the interior of tank or vessel 244 through riser 240. A feature of the riser 240 and for that matter, the riser sections 242, shown in FIGS. 20-23 is that rather than having to connect the small diameter ends to small diameter ends and large diameter ends to large diameter ends of the respective riser sections, in the embodiment shown in FIGS. 20 and 21, the riser sections can be connected such that the small end of one riser section is connected to the large end of an adjacent riser section and so on. Riser section 242 has a frustoconical wall 248 which terminates at its smaller end in a radially inwardly extending, annular lip 250. Lip 250 has an annular extending, axially facing groove 252 and a series of circumferentially spaced holes 254. The opposite, larger diameter end of frustoconical wall 248 is provided with an annular, radially outwardly extending lip 256, lip 256 having an annular, axially facing groove 258 and a plurality of circumferentially spaced holes 260. Positioned between lip 256 of one riser section and lip 250 of an adjacent riser section is a connecting ring 270 shown more clearly in FIG. 22. Connecting ring 270 has an annularly extending base 272 having a first side 274 and a second, opposite side 276. Extending from side 274 is an annular, axially projecting rib 278 while a similar rib 280 extends from surface 276. As can be seen, annular ribs 278 and 280 are concentric with respect to one another, rib 280 being radially innermost, rib 278 being radially outermost relative to base 272.

Figure 21:
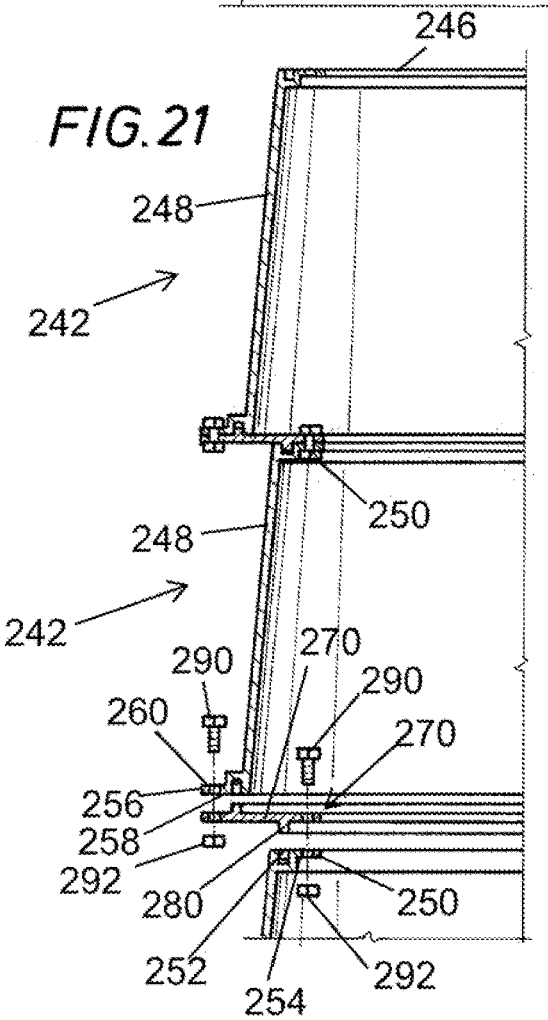
FIG. 21 is a partially exploded, elevational view, showing in greater detail, connection of the riser sections shown in forming the riser of FIG. 20.
Figure 22:
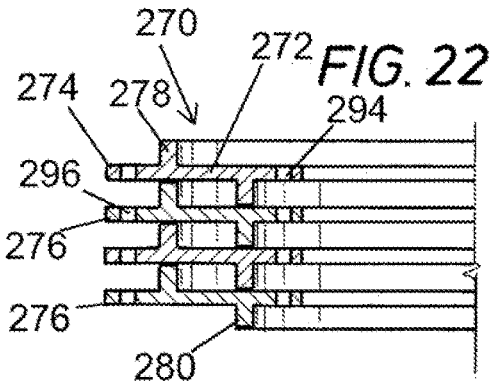
FIG. 22 is an elevational view, partly in section, of a first, stacked set of connecting rings used in connecting the riser sections shown in FIGS. 20 and 21.
Figure 23:
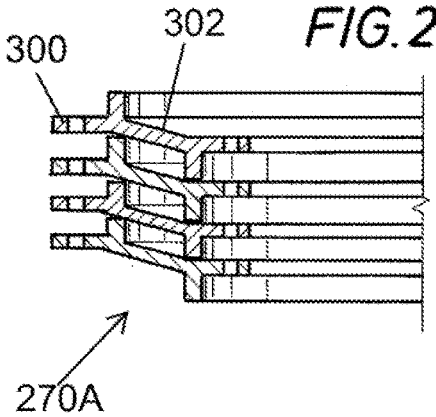
FIG. 23 is a view similar to FIG. 22 showing a modified form of the connecting rings used in connecting the riser sections shown in FIGS. 20 and 21.
Figure 33:
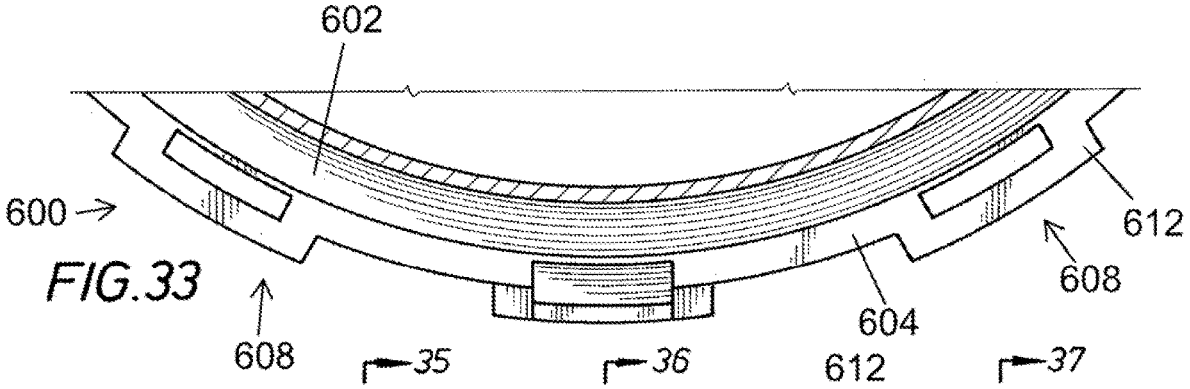
FIG. 33 is a partial, top, planar view, partly in section, showing another embodiment of the riser section of the present invention.
Figure 34:
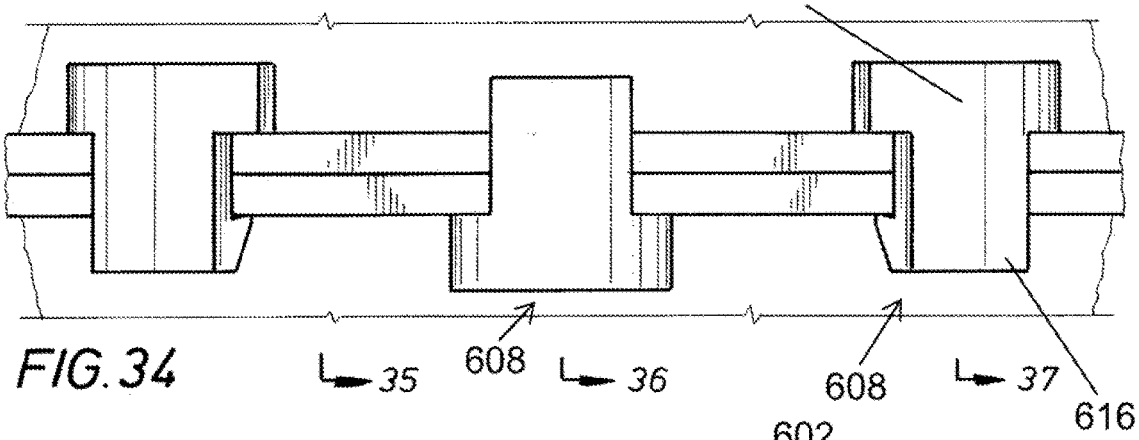
FIG. 34 is a partial, elevational view of the riser section shown in FIG. 33.
Figure 35:
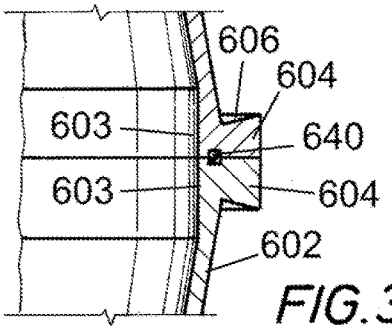
FIG. 35 is a cross-sectional view taken along the lines 35-35 of FIG. 34.
Figure 36:
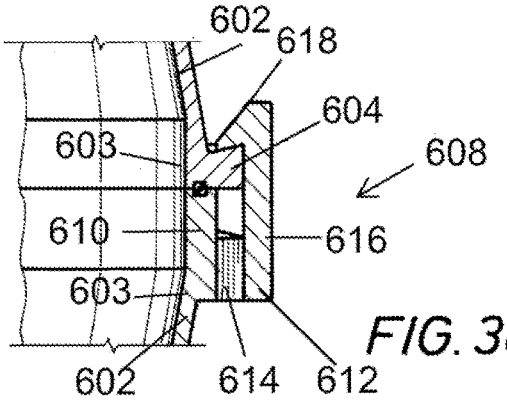
FIG. 36 is a cross-sectional view taken along the lines 36-36 of FIG. 34.
Figure 37:
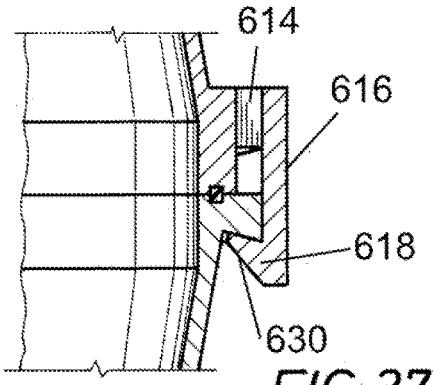
FIG. 37 is a cross-sectional view taken along the lines 37-37 of FIG. 34.

Referring again to FIG. 21, it can be seen how ring 270 can be used to connect successive riser sections 242 together. In this regard, annular rib 278 is received in groove 258 of flange 256 while rib 280 is received in groove 252 of lip 250. Through the use of bolt 290/nut 292 assemblies, ring 270 can be used to connect successive riser sections 242. In this regard, the bolts 290 are received through registering holes 294 in rings 270 and 254 in lip 250 as well as in registering holes 296 in ring 270 and 260 in lip 256. When the nut/bolt combination is tightened, sections 242 are connected together as shown in FIG. 21. Thus, it is able to connect a smaller end of a riser section to a larger end of a riser section in successive steps to create the desired riser length. It will be readily apparent that not only are the riser sections 242 stackable, but, as shown in FIG. 2, the connecting rings 270 are likewise stackable. FIG. 23 shows a slightly modified version of the connecting rings 270. The rings 270A shown in FIG. 23 are structurally similar to rings 270 with the exception that the base has a first, radially outermost portion 300 and a second radially innermost portion 302, both of which are annular, radially innermost portion 302 of the base being angled relative to section 300 of the base to provide greater stiffness of the connecting ring 270.

Referring now to FIGS. 24-28, there is shown yet another embodiment of the riser sections of the present invention. Riser sections 300 are, in some respects, similar to the riser sections shown in FIGS. 13 and 14. In this regard, the riser sections 300 have a frustoconical wall 302 which terminates at its larger end in a radially, outwardly extending annular rib 304, rib 304 being provided with an annular, axially facing groove 306 in which is positioned a seal ring 308. A positioning ring shown generally as 310 is generally cross-shaped in transverse cross-section having vertical legs 314 which are received in grooves 306 and horizontal legs 312 which are positioned between portions of the ribs 304 of the adjacent riser sections 300.

In order to lock sections 300 together, each end of the sections 300 is provided with a series of circumferentially spaced, axially projecting hooks or dogs shown generally as 320. As best seen with reference to FIGS. 24 and 27, the hooks are connected to and radially outwardly of annular rib 304. The hooks or dogs 320 are generally circumferentially spaced around the periphery of the riser sections 300 and have an axially projecting leg portion 322 from which laterally projects a foot portion 324 having an inclined surface 326 giving foot portion 324 a wedge shape. In the position shown in FIGS. 25 and 27, the dogs or hooks 320 are positioned such that they are circumferentially spaced from one another. However, upon relative rotation between the adjoining riser sections as indicated in FIG. 26, the inclined surfaces 326 will ride over another, camming the riser sections 300 together. This is best seen by the direction of arrows A and B showing one section 320 being rotated in the direction of A while the adjacent section 320 is being rotated in the direction of arrow B. This camming action forces the vertical legs 314 of cross-shaped ring 306 into tight engagement with the seal 308. A clear feature of the embodiment shown in FIG. 24 is that no additional fasteners, e.g., nut/bolt assemblies, are required to connect the adjacent riser sections together.

It will be understood that although only the connector assembly at the larger diameter end of the riser sections shown in FIGS. 24 and 28 have been described, a similar connector assembly will be at the opposite, smaller diameter end of the riser section, the difference being that instead of the rib and other connecting pieces being positioned radially outwardly of the larger diameter end of the riser sections as shown in FIGS. 24-28, the rib and other connecting pieces of the connector assembly will be positioned radially inwardly of the smaller diameter end of the riser section.

Turning next to FIGS. 29-32, there is shown another embodiment of the riser section of the present invention. The riser section shown generally as 400 has a frustoconical wall 102, a first, annular, radially inwardly extending flange 404, at the first end 401 of riser section 400, flange 404 having an annular, axially facing clip groove 406. Riser section 400 further has a second, annular, radially outwardly extending flange 408 located at the second end 403 of riser section 400. Flange 408 has an annular, axially facing clip groove 410 (see FIG. 32). Groove 410 faces in the direction of first end 401 of riser section 400 while groove 406 faces in the direction of second end 403 of riser section 400. There is an annular seal ring groove 412 formed in flange 408 on the side opposite clip groove 410. Likewise with respect to flange 408, there is a seal ring groove on the flange 404 on the side opposite of clip groove 406. As can be seen, a seal ring 414 fits into registering grooves 412 when successive riser sections are connected.

In a similar fashion, radially inwardly extending flange 404 on first end 401 of riser section 400 has an annular groove 406 and a seal ring groove/seal ring combination shown generally as 412.

Riser sections 400 are connected to one another by a series of clips shown generally as 500. As can be seen in FIG. 32, clips 500 have a body portion 502 and first and second laterally extending fingers 504 and 506. Fingers 504 and 506 are elastic with respect to body portion 502. Finger 504 has an inwardly extending dog 508 while finger 506 has an inwardly extending dog 510, dogs 508 and 510 defining a slot therebetween. Since fingers 504 and 506 are elastic with respect to body 502, it will be appreciated that the slot width formed by dogs 508 and 510 can be expanded. Accordingly, assuming that clips 500 have the configuration shown in FIG. 32 while unconnected to the riser sections, it will be appreciated that they can be laterally slid over the engaged flanges 408 until the dogs 508 and 510 engage the grooves 410 of the adjacent riser sections. In effect, clips 500 can be snapped over the engaged flanges 408 of adjacent riser sections, thereby compressed together by the force exerted by the elastic fingers 504 and 506.

It will be understood and as seen in the drawings, to connect the other ends of the riser sections 400 together, the same procedure is employed with an exception of course being that at the smaller end of the riser section 400, the clips are on the inside of the walls of the riser section 400 such that the clips extend radially inwardly as opposed to the clips connecting the larger areas of the riser sections which extend radially outwardly. In all other respects, the connection method is the same.

Referring now to FIGS. 33-38, there is shown another embodiment of the riser section of the present invention. The riser section shown generally as 600 has a frustoconical wall 602 terminating at one end in an annular, radially outwardly extending lip 604. As thus seen with reference to FIG. 35, lip 604 has an annular, axially facing surface 606 which is undercut for reasons to be described hereafter.

Figure 38:
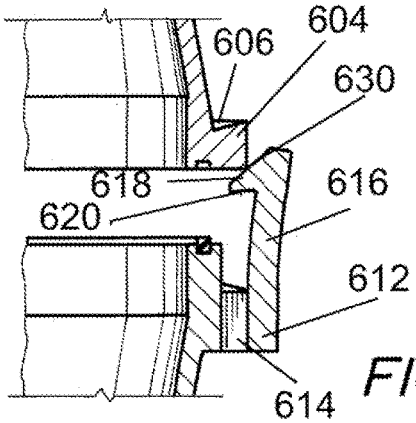
FIG. 38 is a view similar to FIG. 36 showing the riser sections prior to being connected.

There are a plurality of latch assemblies shown generally as 608 at circumferentially spaced intervals adjacent end 610 of the riser section 600. Each latch assembly 608 has a body portion 612 having portions 614 which connect to the wall 602 of riser section 600. Each latch 608 is provided with elastic fingers 616 extending axially from and connected elastically to body portion 612. As best seen in FIG. 38, each finger 616 has a radially inwardly extending dog 618 having an undercut surface 620 which is complementary to undercut surface 606 of lip 604. As can also be seen in FIG. 37, finger 616 has a chamfered surface 630 for reasons to be discussed hereafter.

To connect the end 603 of adjacent riser sections together, it is only necessary to align the end faces of the riser sections and then compressively urge them together. In this regard, and with reference to FIGS. 36 and 38. It will be seen that, in FIG. 38, as the adjacent riser sections 600 are urged together, the chamfered surface 630 on fingers 616 will engage the edge of lip 606 forcing fingers 616 radially outwardly as shown in FIG. 38. Further movement of the two adjacent riser sections together will force fingers 616 even further radially outwardly until the point where lip 606 is underneath dog 618 and undercut surfaces 620 and 606 are in engagement. Since the fingers are elastically connected to body 612, they will then move radially inwardly and the undercut surfaces will exert a wedging effect forcing the two riser sections together. In this regard, and as noted in FIG. 34, the lip portion 604 has a seal ring groove in which is received seal ring 640. Seal ring 640 being received in registering grooves of lips 604.

Although in the description of FIGS. 33-38, the riser section 600 has been described with respect to connection of the larger end of the riser section, it will be appreciated that the same types of connection assemblies can be placed on the smaller end but that they will be located on the inside of the riser sections. In other words, latches would be attached to the inside walls of the riser sections. However, in all respects, the connection assembly would be the same as displayed in FIGS. 33-38.

Other than the riser sections of the present invention being nestable or stackable and therefore much more economical to ship and store, it will be appreciated that most of the riser sections can be formed from a single mold, which can turn out multiple, same height riser sections. Furthermore, the individual riser sections can be made quite short; e.g., three to twelve inches in length and thus becomes quite easy to provide a desired height riser between a buried tank and grade.

It will be appreciated that, although as described above, the riser sections are connected with interlocking keys/keyhole, camming surfaces, nut/bolt assemblies etc., the riser sections could employ other fasteners if desired. However the connection is made between individual sections to form a riser, the desirably is some ability or structure to compress abutting end surfaces of the individual sections together, so that a water tight seal is obtained, either with or without a separate seal member.

In many of the embodiments discussed above, radially projecting lips, ribs, flanges, etc. impact structural stability. It will be appreciated, however, that axially extending ribs or the like on the frustoconical walls of the riser sections could also be employed to impart sufficient structural integrity. In other words, certain of the riser sections could be formed without flanges, lips, ribs or the like at opposite ends of the tapered walls forming the riser sections and connection between the riser sections would be accomplished by formations projecting as to one and receiving as to the other, which were formed on the axially facing ends of the frustoconical walls forming the riser sections. In this manner, there would be substantially no radially projecting ribs, lips, flanges, etc., whether inwardly or outwardly.

Virtually any type of formation projecting as to one and receiving as to the other, or connecting assembly can be employed to connect adjacent ends of the individual riser sections together. However, it is desired that the individual sections be producible from a single mold, although such is not necessary.

As noted above, one advantage of some of the riser sections of the present invention is that a riser can be formed of monolithic pieces. In other words, the riser sections not only form an axial portion of the riser, but the riser sections are connectible to one another by virtue of structures or formations formed on the ends of the individual riser sections which engage to connect them together, as described above. Accordingly, in such cases, as shown, fasteners such as screws, nuts and bolts, etc., could be eliminated.

One of the problems with prior art riser sections which are almost universally connected by means of fasteners such as nut/bolt assemblies, is that these fasteners, because they are made of metal, are prone to corrode and break, meaning that the individual riser sections may leak because the abutting faces of the individual sections are no longer being held together. Furthermore, in the installation, the use of monolithic riser sections of the present invention reduces the number of parts that an installer needs. It will be remembered that, particularly in the case of WWT systems, the WWT system may be installed at a remote location. For efficiency, this necessitates that the installer have all the parts needed to connect the riser sections to form the desired height of the riser. It is not uncommon for an installer, when at a WWT system site, to not have the necessary fasteners, meaning that a further trip must be made to obtain such fasteners so that the individual sections can be connected.

One of the many advantages of the riser sections of the present invention is that inventory can be reduced and accordingly, storage space reduced. For example, if the riser sections are all made with a 3" to 5" vertical height, only riser sections falling within that range need be stored in inventory.

Although as noted above, if a single, desired height riser section is all that is desired, only a single mold is necessary to produce the individual riser sections. However, it is not intended that the present invention be limited to the use of one size mold. For example, if it was desired to have a family of riser sections instead of a single vertical height riser section, multiple molds could be employed, each of the molds having different tapers, such that even though the riser sections would have different heights, they could still be connected together because their ODs at the smaller end and the larger end would still mate; i.e., be in register. Thus, one could form a family of riser sections; e.g., 2", 5", 12", meaning that there would be three different molds of three different tapers, the goal being that the small ends of the riser sections, regardless of their height, would connect together and the large end of the riser sections, regardless of their height, would also connect together; i.e., the small ends of the smallest riser sections and the small ends of the largest riser sections in the family would be in register with one another when they are being connected together as would be the case with the large diameter ends of the riser sections.

Although the riser sections can be made over a wide range of height and diameters, generally, the diameter of the riser sections at the small end of the tapered wall would generally be about 10" or greater, while the diameter of the tapered wall sections on the large end could be as large as 38" or larger.

Although as described above, the riser formed from the riser sections of the present invention has a lid fastened at the upper end of the riser about at grade, it will be understood that it can be made with the same connecting formations used with individual riser sections. Further, the lids could be made in different heights so that almost the exactly desired height of the riser, including the hatch or cover could be achieved. Also, the lids could be made in such a way that individual lid portions could be connected together much in the same way that the individual riser sections are connected together.

It can thus been from the above that the riser sections of the present invention can be connected together using a wide variety of connector assemblies or connectors to form risers of desired length. For example, the riser sections can be connected as shown in FIGS. 1-6 using flange-to-flange and lip-to-lip engagement and employing nut/bolt assemblies and/or key-keyhole arrangements, the latter requiring slight relative rotation between adjoining riser sections. Additionally, individual riser sections can be connected together using camming tabs which extend radially inwardly and radially outwardly from opposite ends of individual riser sections, the camming tabs being engaged to force the riser sections together by relative rotation of the individual riser sections. Additionally, the riser sections can be connected by using certain riser sections having male connections at both ends while other riser sections having female connections at both ends. The riser sections can also be connected together using various connecting assemblies such as rings of various shape which are received in grooves and/or have grooves in which are received splines extending from the individual riser sections. The riser sections can also be connected by camming hooks which project axially from the ends of the riser sections, the camming hooks being engageable by relative rotation of the adjacent riser section. Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described are exemplary, and various other substitutions, alterations and modifications, including but not limited to those design alternatives specifically discussed herein, may be made in the practice of the invention without departing from its scope.

What is claimed is:

1. A tapered riser section comprising:

a riser body having a tapered wall, a first end forming a first opening defined in part by a first axially facing peripheral surface and a second end forming a second smaller opening defined in part by a second axially facing peripheral surface;

at least three circumferentially spaced first latch fingers attached to and projecting laterally outwardly relative to said tapered wall proximate said first peripheral surface, each of said first latch fingers having a portion extending axially beyond said first opening, said first latch fingers having a free end normally held in a first position, a laterally inwardly extending lip being formed on said free end, said first latch fingers being elastically movable from said first position to a second position wherein said free ends of said first latch fingers are radially outwardly relative to said first position of said free ends of said first latch fingers;

a plurality of first latch catch surfaces positioned proximate said first peripheral surface and projecting laterally outwardly, respective ones of said first latch catch surfaces being between adjacent ones of said first latch fingers;

at least three circumferentially spaced second latch fingers attached to and projecting laterally inwardly relative to said tapered wall proximate said second peripheral surface, each of said second latch fingers having a portion extending axially beyond said second opening, said second latch fingers having a free end normally held in a first position, said first latch fingers being elastically movable from said first position to a second position wherein said free ends of said second latch fingers are radially inwardly relative to said first position of said free ends of said second latch fingers;

a plurality of second latch catch surfaces positioned proximate said second peripheral surface and projecting laterally inwardly, respective ones of said second latch catch surfaces being between adjacent ones of said second latch fingers; and wherein said riser body, said first and second latch fingers attached thereto, and said first and second latch catch surfaces attached thereto comprise a monolithic structure.

2. A tapered riser section comprising:

a riser body having a tapered wall, a first end forming a first opening defined in part by a first axially facing peripheral surface and a second end forming a second smaller opening defined in part by a second axially facing peripheral surface;

at least three circumferentially spaced first latch fingers projecting laterally outwardly relative to said tapered wall proximate said first peripheral surface, each of said first latch fingers having a portion extending axially beyond said first opening and being elastically outwardly deflectable, said first latch fingers each having a free end forming a first laterally inwardly extending lip;

a plurality of first latch catch surfaces positioned proximate said first peripheral surface and projecting laterally outwardly, respective ones of said first latch catch surfaces being between adjacent ones of said first latch fingers;

at least three circumferentially spaced second latch fingers attached to and projecting laterally inwardly relative to said tapered wall proximate said second peripheral surface, each of said second latch fingers having a portion extending axially beyond said second opening and being elastically laterally inwardly deflectable, said second latch fingers each having a free end forming a second laterally outwardly extending lip; and a plurality of second latch catch surfaces positioned proximate said second peripheral surface and projecting laterally inwardly, respective ones of said second latch catch surfaces being between adjacent ones of said second latch fingers, said riser body, said first latch fingers, said first latch catch surfaces, said second latch fingers, and said second latch catch surfaces being a monolithic structure.

* * * * *